US011401473B2

(12) United States Patent
Kandel et al.

(10) Patent No.: US 11,401,473 B2
(45) **Date of Patent: *Aug. 2, 2022**

(54) PROCESS TO MAINTAIN HIGH SOLVENCY OF RECYCLE SOLVENT DURING UPGRADING OF STEAM CRACKED TAR

(71) Applicant: ExxonMobil Chemical Patents Inc., Baytown, TX (US)

(72) Inventors: Kapil Kandel, Humble, TX (US); Teng Xu, Houston, TX (US); Glenn A. Heeter, The Woodlands, TX (US); Frank Cheng-Yu Wang, Annandale, NJ (US); Anthony S. Mennito, Flemington, NJ (US); David T. Ferrughelli, Easton, PA (US); Krystle J. Emanuele, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 147 days.

This patent is subject to a terminal disclaimer.

(21) Appl. No.: 16/545,976

(22) Filed: Aug. 20, 2019

(65) Prior Publication Data

US 2020/0071626 A1 Mar. 5, 2020

Related U.S. Application Data

(60) Provisional application No. 62/724,949, filed on Aug. 30, 2018.

(51) Int. Cl.
*C10G 47/24* (2006.01)
*C10G 47/02* (2006.01)

(52) U.S. Cl.
CPC ..... *C10G 47/24* (2013.01); *C10G 47/02* (2013.01); *C10G 2300/107* (2013.01); *C10G 2300/4081* (2013.01); *C10G 2300/807* (2013.01)

(58) Field of Classification Search
CPC ..... C10G 47/02; C10G 47/24; C10G 2300/4081; C10G 2300/807; C10G 2300/107
See application file for complete search history.

(56) References Cited

U.S. PATENT DOCUMENTS 5,871,634 A 2/1999 Wiehe et al.
5,997,723 A 12/1999 Wiehe et al.
(Continued)

FOREIGN PATENT DOCUMENTS

EP 2751234 B 11/2016
WO 2013/033577 A 3/2013
(Continued)

OTHER PUBLICATIONS

Ford, T.J. "Liquid-Phase Thermal Decomposition of Hexadecane: Reaction Mechanisms", Ind. Eng. Chem. Fundam. vol. 25, pp. 240-243, 1986.
(Continued)

*Primary Examiner* — Prem C Singh
*Assistant Examiner* — Brandi M Doyle

(57) ABSTRACT

Processes for improving hydrocarbon feedstock compatibility are provided. More specifically, a process for preparing a liquid hydrocarbon product includes heat soaking a tar stream to produce a reduced reactivity tar and blending the reduced reactivity tar with a utility fluid comprising recycle solvent to produce a lower viscosity, reduced reactivity tar. The process also includes hydroprocessing the lower viscosity, reduced reactivity tar at a temperature of greater than 350° C. to produce a total liquids product containing the liquid hydrocarbon product and the recycle solvent. The process further includes separating the recycle solvent from the total liquids product, where the recycle solvent has the $S_{BN}$ of greater than 110, and flowing the recycle solvent to
(Continued)

the reduced reactivity tar for blending to produce the lower viscosity, reduced reactivity tar.

26 Claims, 4 Drawing Sheets

(56) References Cited

U.S. PATENT DOCUMENTS

| | | | | |
|---|---|---|---|---|
| 2013/0233764 | A1 | 9/2013 | Brown et al. | |
| 2014/0061095 | A1* | 3/2014 | Beech, Jr. ..... | C10G 69/06 208/73 |
| 2015/0315496 | A1 | 11/2015 | Soultanidis et al. | |
| 2015/0368570 | A1 | 12/2015 | Beech, Jr. et al. | |
| 2016/0122667 | A1* | 5/2016 | Evans ..... | C10G 9/36 208/70 |

FOREIGN PATENT DOCUMENTS

| | | | |
|---|---|---|---|
| WO | 2013/033580 | A | 3/2013 |
| WO | 2013/033590 | A | 3/2013 |
| WO | 2018/111572 | A | 6/2018 |
| WO | 2018/111574 | A | 6/2018 |

OTHER PUBLICATIONS

Kissin, Y.V., "Free-Radical Reactions of High Molecular Weight Isoalkanes", Ind. Eng. Chem. Res. vol. 26, pp. 1633-1638, 1987.
Kossiakoff, A., et al. "Thermal Decomposition of Hydrocarbons, Resonance Stabilization and Isomerization of Free Radicals", Journal of American Chemical Society, vol. 65, pp. 590-595, 1943.
Fabuss, B.M., et al. "Thermal Cracking of Pure Saturated Hydrocarbons", Adv. Pet. Chem., Ref 9, Chapter 4, pp. 157-201, 1964.

* cited by examiner

PROCESS TO MAINTAIN HIGH SOLVENCY OF RECYCLE SOLVENT DURING UPGRADING OF STEAM CRACKED TAR

PRIORITY

This application claims priority to and the benefit of U.S. Provisional Application No. 62/724,949, filed Aug. 30, 2018, the disclosure of which is incorporated herein by reference in its entirety.

FIELD

Embodiments generally relate to improving hydrocarbon feedstock compatibility. More particularly, embodiments relate to processes which include combining a hydrocarbon feedstock and a utility fluid comprising recycle solvent to segregate components of the feed into separable fractions, to the hydrocarbon products of such processes, and to equipment useful for such processes.

BACKGROUND

Pyrolysis tar is a form of tar produced by hydrocarbon pyrolysis. One form of pyrolysis tar, steam cracker tar ("SCT"), contains a plurality of component species including high molecular weight molecules such as asphaltenes that are generated during the pyrolysis process and typically boil above 560° F. These asphaltenes molecules have low H/C and high sulfur content which contributes to high viscosity and high density of SCT.

Solvent Assisted Tar Conversion (SATC) is an SCT upgrading process that includes mixing SCT with a utility fluid and upgrading the mixture into less viscous and less dense products including a hydroprocessed tar and solvent. At least a portion of the solvent can be recovered and recycled to the process, and the utility fluid can comprise recycled solvent. The upgrading can include cracking and hydroprocessing, e.g., one or more of thermal cracking, hydrocracking, and hydrogenation. The process is typically carried out under pressure and weight hourly space velocity ("WHSV") conditions that are selected to optimize one or more of SCT conversion, hydroprocessed tar yield/quality, and solvent yield/and quality. Operating temperature is also an important process parameter that can be adjusted to maintain the desired solvent quality. While the hydrogenation of aromatic molecules is favored when hydroprocessing at lower temperature (e.g., about 300° C.), a lesser amount of cracking occurs. This will increase the partially and/or completely hydrogenated molecules in the product which will eventually be present in recycle solvent after distillation. The increase in amount of hydrogenated molecules in recycle solvent decreases the solvency power of the recycle solvent, in turn, reduces the ability of the recycle solvent to dissolve tar components. Another feature of SATC is the recycle of a cut of self-generated product as solvent. The amount of solvent recycled for use as utility fluid is typically about 20 wt % to about 60 wt %, e.g., about 40 wt %. Solvent recovered from a SATC process typically has a desirably high solvency power, as indicated by the solvent's appreciable solubility blending number ($S_{BN}$). If the $S_{BN}$ of the recovered solvent is less than 100, such as about 80 or about 90, the recycle solvent has a decreased ability to dissolve the tar, and is therefore less desirable for use as utility fluid or utility fluid constituent.

Additional circumstances such as start-up at lower temperature (fresh catalyst) and turndown (slower feed rate) can also lead to accumulation of hydrogenated/naphthenic molecules in the mid-cut recycled solvent. Furthermore, the entrainment of smaller naphthenic molecules in recycle solvent due to less efficient distillation can also affect solvent quality.

There remains a need for further improvements in the hydroprocessing of pyrolysis tars while improving the quality of recycled solvent, for example, by reducing the accumulation of hydrogenated molecules in recycle solvent.

SUMMARY

Embodiments provide processes that include maintaining a high solvency power for the recycle solvent so that the recycle solvent can be used as a utility fluid or utility fluid constituent for blending with SCT. The processes utilize as a feed at least one pyrolysis tar having a reactivity ("$R_T$"), e.g., as indicated by a bromine number ("BN") that does not exceed 28. Such a pyrolysis tar, which can be an SCT, is referred to as a "reduced reactivity tar". The reduced reactivity tar is combined with a utility fluid comprising recycle solvent to produce a tar-fluid mixture, which is also referred to herein as "a lower viscosity, reduced reactivity tar". An $S_{BN}$ of greater than 110, such as from about 115, about 120, or about 130 to about 133, about 135, about 138, about 140, about 145, or about 150, results in a desirably high solvency power for the recycle solvent when it is used as utility fluid or utility fluid constituent. It has been discovered that when the lower viscosity, reduced reactivity tar is hydroprocessed at a temperature of greater than 350° C. to about 500° C., such as about 400° C. to about 450° C., the recovered recycle solvent has the desired high solvency power.

In one or more embodiments, a process for preparing a liquid hydrocarbon product includes providing a reduced reactivity tar (e.g., by heat soaking an SCT of greater reactivity) and blending the reduced reactivity tar with a utility fluid comprising recycle solvent, and/or with a utility fluid comprising a different solvent having properties that are substantially the same as those of the recycle solvent, to produce a lower viscosity, reduced reactivity tar. The process also includes hydroprocessing the lower viscosity, reduced reactivity tar at a temperature of greater than 350° C. to produce a total liquids product at the hydroprocessor outlet (TLP) comprising (i) solvent which can be recovered and recycled for use as utility fluid or a utility fluid component and (ii) liquid hydrocarbon product comprising hydroprocessed tar. Certain aspects of the process further comprise separating from the TLP a recycle solvent having an $S_{BN}$>110, and flowing the recycle solvent to the reduced reactivity tar for blending to produce the lower viscosity, reduced reactivity tar.

In one or more examples, the utility fluid has an $S_{BN}$ of 115 or greater, and the method further includes increasing the temperature of the lower viscosity, reduced reactivity tar during the hydroprocessing if the $S_{BN}$ of the recycle solvent is less than 115. The lower viscosity, reduced reactivity tar can be hydroprocessed at a temperature of greater than 350° C. to about 500° C., such as about 400° C. to about 450° C. The $S_{BN}$ of the recycle solvent can be greater than 110 to about 160, such as greater than 120 to about 150 or from about 130 to about 150.

In other examples, the process further includes centrifuging the lower viscosity, reduced reactivity tar to remove solids therefrom prior to hydroprocessing. After solids-removal (e.g., by centrifuging), the lower viscosity, reduced reactivity tar is completely or substantially free of solids having a size of greater than 25 μm.

The recycle solvent can be or include aromatic compounds, such as two-ring aromatics, three-ring aromatics, four-ring aromatics, or any combination thereof. In some examples, the recycle solvent can be or include one or more solvents, such as benzene, ethylbenzene, trimethylbenzene, xylenes, toluene, naphthalenes, alkylnaphthalenes, tetralins, alkyltetralins, or any combination thereof.

In one or more examples, the hydroprocessing of the lower viscosity, reduced reactivity tar can include heating the lower viscosity, reduced reactivity tar to a temperature of about 260° C. to about 300° C. in a pretreater containing hydrogen, then heating the pretreated lower viscosity, reduced reactivity tar to a temperature of about 325° C. to about 375° C. in a first reactor containing hydrogen, then heating the lower viscosity, reduced reactivity tar to a temperature of about 360° C. to about 450° C. in a second reactor containing hydrogen.

In another embodiment, a process for preparing a liquid hydrocarbon product includes heat soaking a pyrolysis tar to produce a reduced reactivity tar, blending the reduced reactivity tar with a utility fluid comprising recycle solvent to produce a lower viscosity, reduced reactivity tar, and centrifuging the lower viscosity, reduced reactivity tar to remove solids therefrom. Thereafter, the process includes hydroprocessing the lower viscosity, reduced reactivity tar at a temperature of greater than 350° C. to produce a TLP containing the liquid hydrocarbon product and the recycle solvent. The process also includes separating the recycle solvent from the TLP, where the recycle solvent has the $S_{BN}$ of greater than 115 and flowing the recycle solvent to the reduced reactivity tar for blending to produce the lower viscosity, reduced reactivity tar. In one or more examples, the process includes increasing the temperature of the lower viscosity, reduced reactivity tar during the hydroprocessing if an $S_{BN}$ of the recycle solvent is less than 120.

In other embodiments, a process for preparing a liquid hydrocarbon product includes heat soaking a tar stream to produce a reduced reactivity tar, blending the reduced reactivity tar with a utility fluid comprising recycle solvent to produce a lower viscosity, reduced reactivity tar, and hydroprocessing the lower viscosity, reduced reactivity tar at a temperature of greater than 350° C. to produce the TLP containing the liquid hydrocarbon product and the recycle solvent. The process also includes separating the recycle solvent from the TLP, measuring an $S_{BN}$ of the recycle solvent, increasing the temperature of the lower viscosity, reduced reactivity tar during the hydroprocessing if the $S_{BN}$ of the recycle solvent is less than 115, and flowing the recycle solvent to the reduced reactivity tar for blending to produce the lower viscosity, reduced reactivity tar.

In one or more embodiments, a process for preparing a liquid hydrocarbon product includes thermally treating (e.g., heat soaking) a tar stream to produce a tar composition having a reactivity $R_C \leq 28$ BN (a reduced reactivity tar). The process further comprises blending a first process stream comprising the reduced reactivity tar with a utility fluid comprising recycle solvent to reduce viscosity of the first process stream and produce a second process stream containing solids and a reduced reactivity, lower viscosity tar. The process also includes centrifuging the second process stream to produce a third process stream containing the reduced reactivity, lower viscosity tar and having a concentration of solids less than the second process stream and hydroprocessing the third process stream at a temperature of greater than 350° C. to about 450° C. to produce a fourth stream containing the liquid hydrocarbon product and the recycle solvent. The process further includes separating the recycle solvent from the fourth stream, where the recycle solvent has an $S_{BN}$ of about 130 to about 150 and flowing the recycle solvent to the first process stream for blending to produce the second process stream.

In other embodiments, the hydrocarbon products of any of the foregoing processes, and to mixtures containing any of such hydrocarbon products and a second hydrocarbon, particularly mixtures which are substantially free of precipitated asphaltenes are provided.

These and other features, aspects, and advantages of the processes will become better understood from the following description, appended claims, and accompanying drawings.

DETAILED DESCRIPTION

Figure 1:
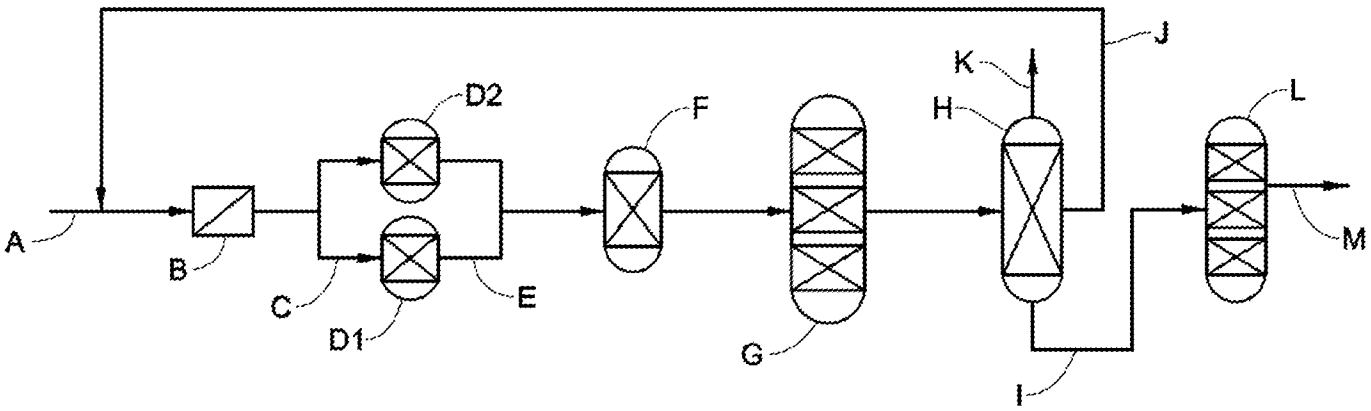
FIG. 1 depicts an exemplary process flow of a tar disposition process according to one or more embodiments.

Embodiments provide processes that include the discovery to preferentially maintain a high solvency power for the recycle solvent that is used as a utility fluid or utility fluid constituent for blending with a reduced reactivity to produce a lower viscosity, reduced reactivity tar. A solubility blending number ($S_{BN}$) of greater than 110, such as from about 115, about 120, or about 130 to about 133, about 135, about 138, about 140, about 145, or about 150, results in high solvency power for the recycle solvent and typically for utility fluid comprising the recycle solvent. In some embodiments, the process is based in part on the discovery that by hydroprocessing the lower viscosity, reduced reactivity tar at a temperature of greater than 350° C. to about 500° C., such as about 400° C. to about 450° C., helps to produce, among other products, a recycle solvent having a high solvency power.

Definitions

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point ≥200° C. For certain pyrolysis tars, ≥90 wt % of the pyrolysis tar has a boiling point at atmospheric pressure ≥550° F. (290° C.). Pyrolysis tar can contain, e.g., ≥50 wt %, e.g., ≥75 wt %, such as ≥90 wt %, based on the weight of the pyrolysis tar, of hydrocarbon molecules (including mixtures and aggregates thereof) having (i) one or more aromatic components, and (ii) a number of carbon atoms ≥about 15. Pyrolysis tar generally has a metals content $\leq 1.0 \times 10^3$ ppmw, based on the weight of the pyrolysis tar, which is an amount of metals that is far less than that found in crude oil (or crude oil components) of the same average viscosity.

"Olefin content" means the portion of the tar that contains hydrocarbon molecules having olefinic unsaturation (at least one unsaturated carbon that is not an aromatic unsaturation) where the hydrocarbon may or may not also have aromatic unsaturation. For instance, a vinyl hydrocarbon like styrene, if present in the pyrolysis tar, would be included in the olefin content. Pyrolysis tar reactivity has been found to correlate strongly with the pyrolysis tar's olefin content. A tar, e.g., a pyrolysis tar such as SCT, having a bromine number reactivity ("R") of 28 or less ($R_T \leq 28$ BN). A tar having a reactivity $R_T > 28$ BN can be subjected to one or more thermal treatments (e.g. at least one heat soak) to produce a pyrolysis tar composition having a reactivity $R_C \leq 28$ BN. A tar having an $R_T \leq 28$ BN and a tar composition having an $R_C \leq 28$ BN are each a "reduced reactivity tar".

Generally, tar is hydroprocessed in the presence of the specified utility fluid, e.g., as a mixture of tar and the specified utility fluid (a "tar-fluid" mixture). Although it is typical to determine reactivity ("$R_M$") of a tar-fluid mixture containing a thermally-treated pyrolysis tar composition of reactivity $R_C$, it is within the scope of the invention to determine reactivity of the pyrolysis tar ($R_T$ and/or $R_M$) itself. Utility fluids generally have a reactivity $R_U$ that is much less than pyrolysis tar reactivity. Accordingly, $R_C$ of a pyrolysis tar composition can be derived from $R_M$ of a tar-fluid mixture containing the pyrolysis tar composition, and vice versa, using the relationship $R_M \sim [R_C*(\text{weight of tar})+R_U*(\text{weight of utility fluid})]/(\text{weight of tar}+\text{weight of utility fluid})$. For instance, if a utility fluid having $R_U$ of 3 BN, and the utility fluid is 40% by weight of the tar-fluid mixture, and if $R_C$ (the reactivity of the neat pyrolysis tar composition) is 18 BN, then $R_M$ is approximately 12 BN.

"Tar Heavies" (TH) are a product of hydrocarbon pyrolysis having an atmospheric boiling point ≥565° C. and containing ≥5 wt % of molecules having a plurality of aromatic cores based on the weight of the product. The TH are typically solid at 25° C. and generally include the fraction of SCT that is not soluble in a 5:1 (vol.:vol.) ratio of n-pentane:SCT at 25° C. TH generally includes asphaltenes and other high molecular weight molecules.

Insolubles Content ("IC") means the amount in wt % of components of a hydrocarbon-containing composition that are insoluble in a mixture of 25% by volume heptane and 75% by volume toluene. The hydrocarbon-containing composition can be an asphaltene-containing composition, e.g., one or more of pyrolysis tar; thermally-treated pyrolysis tar; hydroprocessed pyrolysis tar; and mixtures containing a first hydrocarbon-containing component and a second component which includes one or more of pyrolysis tar, thermally-treated pyrolysis tar, and hydroprocessed pyrolysis tar.

Equivalent isothermal temperature ("EIT") is a weighted average temperature of the temperatures of multiple catalyst beds in a reactor. The EIT can be used as a reactor temperature, a hydroprocessing temperature, or a temperature in a reactor or other type of vessel or chamber where one or more materials (e.g., tar or hydrocarbon), products, or streams are being hydroprocessed and/or heated.

Process Overview

FIG. 1 shows an overview of certain aspects of the instant process. A tar stream to be processed A is thermally treated to reduce reactivity during transport to a centrifuge B. A recycle solvent J used as a utility fluid (which may act as a solvent for at least a portion of the tar's hydrocarbon compounds) that may be added to the tar stream to reduce viscosity. Recycle solvent may be recovered from the process for recycle to as shown. A filter (not shown) may be included in the transport line to remove relatively large insolubles, e.g., relatively large solids. The thermally processed tar stream is centrifuged to remove insoluble (e.g., solids) having a size of 25 μm or greater. In one or more examples, after centrifuging, the thermally processed tar stream (e.g., the lower viscosity, reduced reactivity tar) is substantially free of insoluble or solids having a size of greater than 25 μm. The "cleared" liquid product tar stream is fed to a guard reactor, in the present illustration via a pretreatment manifold C, which directs the tar stream between an online guard reactor D1 and a guard reactor D2 that can be held offline, for instance for maintenance. The guard reactor is operated under mild hydroprocessing conditions to further reduce the tar reactivity. The effluent from the guard reactor passes through an outlet manifold E to a pretreatment hydroprocessing reactor F for further hydroprocessing under somewhat harsher conditions and with a more active catalyst. The effluent from the pretreatment hydroprocessing reactor passes to a hydroprocessing reactor G (the Intermediate Hydroprocessing reactor) for further hydroprocessing under yet more severe conditions to obtain a Total Liquid Product ("TLP") that is of blending quality, but typically remains somewhat high in sulfur. Recovery facility H includes at least one separation, e.g., fractionation, for separating from the TLP (i) a light stream K suitable for fuels use, (ii) a bottom fraction I which includes heavier components of the TLP, and (iii) a mid-cut. At least a portion of the mid-cut can be recycled (as recycle solvent) to the tar feed via line J for use as utility fluid or a utility fluid constituent. The bottoms fraction I is fed to a $2^{nd}$ Stage hydroprocessing reactor L for additional hydroprocessing that provides desulfurization. The effluent stream M from the $2^{nd}$ Stage hydroprocessing reactor is of low sulfur content and is suitable for blending into an ECA compliant fuel.

Pyrolysis Tar

Representative tars, such as pyrolysis tars, will now be described in more detail. Embodiments of the present disclosure are not limited to use of these pyrolysis tars, and this description is not meant to foreclose use of other pyrolysis tars, e.g., tars derived from the pyrolysis of coal and/or the pyrolysis of biological material (e.g., biomass) within the broader scope of the invention. Pyrolysis tar is a product or by-product of hydrocarbon pyrolysis, e.g., steam cracking. Effluent from the pyrolysis is typically in the form of a mixture containing unreacted feed, unsaturated hydrocarbon produced from the feed during the pyrolysis, and pyrolysis tar. The pyrolysis tar typically contains ≥90 wt %, of the pyrolysis effluent's molecules having an atmospheric boiling point of ≥290° C. Besides hydrocarbon, the feed to pyrolysis optionally further contains diluent, e.g., one or more of nitrogen, argon, water, aqueous solution, or any combination thereof.

Steam cracking, which produces SCT, is a form of pyrolysis which uses a diluent containing an appreciable amount of steam. Steam cracking will now be described in more detail. Embodiments of the invention are not limited to SCT processing, and this description is not meant to foreclose the processing of other tars, e.g., other pyrolysis tars, within the broader scope of the invention.

Steam Cracking

A steam cracking plant can include a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as $NO_x$. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C., (ii) a pressure in the range from 1 bar to 5 bars (absolute), or (iii) a cracking residence time in the range from 0.10 seconds to 2 seconds.

Steam cracking effluent is conducted out of the radiant section and is quenched, typically with water or quench oil. The quenched steam cracking effluent ("quenched effluent") is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, SCT, water, light saturated hydrocarbon, molecular hydrogen, or any combination thereof.

Steam cracking feed typically contains hydrocarbon and steam, e.g., ≥10 wt % hydrocarbon, based on the weight of the steam cracking feed, e.g., ≥25 wt %, ≥50 wt %, such as ≥65 wt %. Although the hydrocarbon can be or include one or more light hydrocarbons (e.g., methane, ethane, propane, butane, pentane, or any combination thereof), it can be particularly advantageous to include a significant amount of higher molecular weight hydrocarbon. While doing so typically decreases feed cost, steam cracking such a feed typically increases the amount of SCT in the steam cracking effluent. One suitable steam cracking feed contains ≥1 wt %, e.g., ≥10 wt %, such as ≥25 wt %, or ≥50 wt % (based on the weight of the steam cracking feed) of hydrocarbon compounds that are in the liquid and/or solid phase at ambient temperature and atmospheric pressure.

The hydrocarbon portion of a steam cracking feed typically contains ≥10 wt %, e.g., ≥50 wt %, such as ≥90 wt % (based on the weight of the hydrocarbon) of one or more of naphtha, gas oil, vacuum gas oil, waxy residues, atmospheric residues, residue admixtures, or crude oil; including those containing ≥about 0.1 wt % asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms. One or more vapor-liquid separators can be used upstream of the radiant section, e.g., for separating and conducting away a portion of any non-volatiles in the crude oil or crude oil components. In certain aspects, such a separation stage is integrated with the steam cracker by preheating the crude oil or fraction thereof in the convection section (and optionally by adding of dilution steam), separating a bottoms steam containing non-volatiles, and then conducting a primarily vapor overhead stream as feed to the radiant section.

Suitable crude oils include, e.g., high-sulfur virgin crude oils, such as those rich in polycyclic aromatics. For example, the steam cracking feed's hydrocarbon can include ≥90 wt % of one or more crude oils and/or one or more crude oil fractions, such as those obtained from an atmospheric APS and/or VPS; waxy residues; atmospheric residues; naphthas contaminated with crude; various residue admixtures; and SCT.

SCT is typically removed from the quenched effluent in one or more separation stages, e.g., as a bottoms stream from one or more tar drums. Such a bottoms stream typically contains ≥90 wt % SCT, based on the weight of the bottoms stream. The SCT can have, e.g., a boiling range ≥about 550° F. (290° C.) and can contain molecules and mixtures thereof having a number of carbon atoms ≥about 15. Typically, quenched effluent includes ≥1 wt % of $C_2$ unsaturates and ≥0.1 wt % of TH, the weight percents being based on the weight of the pyrolysis effluent. It is also typical for the quenched effluent to contain ≥0.5 wt % of TH, such as ≥1 wt % TH.

Representative SCTs will now be described in more detail. The invention is not limited to use of these SCTs, and this description is not meant to foreclose the processing of other tars within the broader scope of the invention, e.g., other pyrolysis tars.

Steam Cracker Tar

Conventional separation equipment can be used for separating SCT and other products and by-products from the quenched steam cracking effluent, e.g., one or more flash drums, knock out drums, fractionators, water-quench towers, indirect condensers, or any combination thereof. Suitable separation stages are described in U.S. Pat. No. 8,083,931, for example. SCT can be obtained from the quenched effluent itself and/or from one or more streams that have been separated from the quenched effluent. For example, SCT can be obtained from a steam cracker gas oil stream and/or a bottoms stream of the steam cracker's primary fractionator, from flash-drum bottoms (e.g., the bottoms of one or more tar knock out drums located downstream of the pyrolysis furnace and upstream of the primary fractionator), or a combination thereof. Certain SCTs are a mixture of primary fractionator bottoms and tar knock-out drum bottoms.

A typical SCT stream from one or more of these sources generally contains ≥90 wt % of SCT, based on the weight of the stream, e.g., ≥95 wt %, such as ≥99 wt %. More than 90 wt % of the remainder of the SCT stream's weight (e.g., the part of the stream that is not SCT, if any) is typically particulates. The SCT typically includes ≥50 wt %, e.g., ≥75 wt %, such as ≥90 wt % of the quenched effluent's TH, based on the total weight TH in the quenched effluent.

The TH are typically in the form of aggregates which include hydrogen and carbon and which have an average size in the range of 10 nm to 300 nm in at least one dimension and an average number of carbon atoms ≥50. Generally, the TH contains ≥50 wt %, e.g., ≥80 wt %, such as ≥90 wt % of aggregates having a C:H atomic ratio in the range from 1 to 1.8, a molecular weight in the range of 250 to 5,000, and a melting point in the range of 100° C. to 700° C.

Representative SCTs typically have (i) a TH content in the range from 5.0 wt % to 40.0 wt %, based on the weight of the SCT, (ii) an API gravity (measured at a temperature of 15.8° C.) of ≤8.5° API, such as ≤8.0° API, or ≤7.5° API; and (iii) a 50° C. viscosity in the range of 200 cSt to $1.0\times10^7$ cSt, e.g., $1\times10^3$ cSt to $1.0\times10^7$ cSt, as determined by A.S.T.M. D445. The SCT can have, e.g., a sulfur content that is ≥0.5 wt %, or ≥1 wt %, or more, e.g., in the range of 0.5 wt % to 7 wt %, based on the weight of the SCT. In aspects where steam cracking feed does not contain an appreciable amount of sulfur, the SCT can contain ≤0.5 wt % of sulfur, e.g., ≤0.1 wt %, such as ≤0.05 wt % of sulfur, based on the weight of the SCT.

The SCT can have, e.g., (i) a TH content in the range from 5 wt % to 40 wt %, based on the weight of the SCT; (ii) a density at 15° C. in the range of 1.01 g/cm$^3$ to 1.19 g/cm$^3$, e.g., in the range of 1.07 g/cm$^3$ to 1.18 g/cm$^3$; and (iii) a 50° C. viscosity ≥200 cSt, e.g., ≥600 cSt, or in the range from 200 cSt to $1.0\times10^7$ cSt. The specified hydroprocessing is particularly advantageous for SCTs having 15° C. density that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a 50° C. kinematic viscosity $\geq1.0\times10^4$ cSt, such as $\geq1.0\times10^5$ cSt, or $\geq1.0\times10^6$ cSt, or even $\geq1.0\times10^7$ cSt. Optionally, the SCT has an $I_N\geq80$ and ≥70 wt % of the SCT's molecules have an atmospheric boiling point of ≥290° C. Typically, the SCT has an insoluble content ("ICT")≥0.5 wt %, e.g., ≥1 wt %, such as ≥2 wt %, or ≥4 wt %, or ≥5 wt %, or ≥10 wt %.

Optionally, the SCT has a normal boiling point ≥290° C., a viscosity at 15° C.$\geq1\times10^4$ cSt, and a density ≥1.1 g/cm$^3$. The SCT can be a mixture which includes a first SCT and one or more additional pyrolysis tars, e.g., a combination of the first SCT and one or more additional SCTs. When the SCT is a mixture, it is typical for at least 70 wt % of the mixture to have a normal boiling point of at least 290° C., and include olefinic hydrocarbon which contribute to the tar's reactivity under hydroprocessing conditions. When the mixture contains first and second pyrolysis tars (one or more of which is optionally an SCT)≥90 wt % of the second pyrolysis tar optionally has a normal boiling point ≥290° C.

It has been found that an increase in reactor fouling occurs during hydroprocessing of a tar-fluid mixture containing an SCT having an excessive amount of olefinic hydrocarbon. In order to lessen the amount of reactor fouling, it is beneficial for an SCT in the tar-fluid mixture to have an olefin content of ≤10 wt % (based on the weight of the SCT), e.g., ≤5 wt %, such as ≤2 wt %. More particularly, it has been observed that less reactor fouling occurs during the hydroprocessing when the SCT in the tar-fluid mixture has (i) an amount of vinyl aromatics of ≤5 wt % (based on the weight of the SCT), e.g., ≤3 wt %, such as ≤2 wt % and/or (ii) an amount of aggregates which incorporate vinyl aromatics of ≤5 wt % (based on the weight of the SCT), e.g., ≤3 wt %, such as ≤2.0 wt %. It is also observed that less fouling of the guard reactor and/or pretreater occurs when the thermally treated tar (e.g., heat soaked SCT) is subjected to the specified insolubles-removal treatment, e.g., using filtration and/or centrifugation. The decreased fouling in the guard reactor and pretreater is advantageous because it results in longer guard reactor and pretreater run lengths, e.g., run lengths comparable to those of reactors G and L (FIG. 1). This decreases the need for additional guard reactor and pretreater reactors, which would otherwise be needed, e.g., to substitute for a pretreater reactor brought off-line for regeneration while reactors G and L continue in operation. See, e.g., guard reactor 704B, which can be brought on-line while guard reactor 704A undergoes regeneration, e.g., by stripping with molecular hydrogen.

Utility Fluids

Typically, the utility fluids comprises aromatic hydrocarbon, has an $S_{BN}\geq100$, e.g., ≥110, such as ≥120, or ≥140, and has a true boiling point distribution with an initial boiling point ≥130° C. (266° F.) and a final boiling point ≤566° C. (1,050° F.). The utility fluid can comprise (or consist essentially of or even consist of) recycle solvent, typically contain a mixture of multi-ring compounds. The rings can be aromatic or non-aromatic, and can contain a variety of substituents and/or heteroatoms. For example, a utility fluid can contain ring compounds in an amount ≥40 wt %, ≥45 wt %, ≥50 wt %, ≥55 wt %, or ≥60 wt %, based on the weight of the utility fluid. In certain aspects, at least a portion of a utility fluid is obtained as recycle solvent from a hydroprocessor effluent, e.g., by one or more separations. This can be carried out as disclosed in U.S. Pat. No. 9,090,836, which is incorporated by reference herein in its entirety.

Typically, recycle solvent contains aromatic hydrocarbon, e.g., ≥25 wt %, such as ≥40 wt %, or ≥50 wt %, or ≥55 wt %, or ≥60 wt % of aromatic hydrocarbon, based on the weight of the recycle solvent. The aromatic hydrocarbon can include, e.g., one, two, and three ring aromatic hydrocarbon compounds. For example, the recycle solvent can contain ≥15 wt % of 2-ring and/or 3-ring aromatics, based on the weight of the utility fluid, such as ≥20 wt %, or ≥25 wt %, or ≥40 wt %, or ≥50 wt %, or ≥55 wt %, or ≥60 wt %. Utilizing a recycle solvent containing aromatic hydrocarbon compounds having 2-rings and/or 3-rings as utility fluid or a utility fluid constituent is advantageous because these compounds typically exhibit an appreciable solvency power, e.g., an $S_{BN}\geq100$. In one or more examples, the $S_{BN}$ of the recycle solvent can be ≥110, ≥115, ≥120, or ≥125 to about 130, about 133, about 135, about 138, about 140, about 145, about 150, about 155, or about 160. In some examples, the $S_{BN}$ is of the recycle solvent can be ≥100 to about 160, ≥110 to about 160, ≥110 to about 155, ≥110 to about 150, ≥110 to about 145, ≥110 to about 140, ≥110 to about 135, ≥110 to about 130, ≥115 to about 160, ≥115 to about 155, ≥115 to about 150, ≥115 to about 145, ≥115 to about 140, ≥115 to about 135, ≥115 to about 130, ≥120 to about 160, ≥120 to about 155, ≥120 to about 150, ≥120 to about 145, ≥120 to about 140, ≥120 to about 135, ≥120 to about 130, ≥125 to about 160, ≥125 to about 155, ≥125 to about 150, ≥125 to about 145, ≥125 to about 140, ≥125 to about 135, ≥125 to about 130, ≥130 to about 160, ≥130 to about 155, ≥130 to about 150, ≥130 to about 145, ≥130 to about 140, or ≥130 to about 135.

In another embodiment, if the $S_{BN}$ of the recycle solvent decreases during processing and is less than a predetermined desired value (e.g., 110, 115, 120, 125, or 130), then the temperature of the fluid or tar (e.g., the lower viscosity, reduced reactivity tar) during the hydroprocessing is increased in order to increase the solvency of the recycle solvent so to have an $S_{BN}$ of equal to or greater than the predetermined value. For example, if the $S_{BN}$ of the recycle solvent decreases during processing to a value ≤115, then the temperature of the fluid or tar (e.g., the lower viscosity, reduced reactivity tar; or the tar-fluid mixture) during the hydroprocessing (e.g., in reactor G) is increased to a temperature of greater than 350° C. to about 500° C. or about 400° C. to about 450° C., or 410° C. to 440° C., or 420° C. to 430° C. in order to increase the solvency of the recycle solvent so to have a $S_{BN}$ of equal to or greater than 115.

Such a recycle solvent typically contains a major amount of 2 to 4 ring aromatics, with some being partially hydrogenated. In one or more examples, the recycle solvent can be or include one or more solvents, such as benzene, ethylbenzene, trimethylbenzene, xylenes, toluene, naphthalenes, alkylnaphthalenes, tetralins, alkyltetralins, or any combination thereof.

Under the specified process conditions, the recycle solvent typically has an A.S.T.M. D86 10% distillation point ≥60° C. and a 90% distillation point ≤425° C., e.g., ≤400° C. In certain aspects, the recycle solvent has a true boiling point distribution with an initial boiling point ≥130° C. (266° F.) and a final boiling point ≤566° C. (1,050° F.). In other aspects, the recycle solvent has a true boiling point distribution with an initial boiling point ≥150° C. (300° F.) and a final boiling point ≤430° C. (806° F.). In still other aspects, the recycle solvent has a true boiling point distribution with an initial boiling point ≥177° C. (350° F.) and a final boiling point ≤425° C. (797° F.). True boiling point distributions (the distribution at atmospheric pressure) can be determined, e.g., by conventional methods such as the method of A.S.T.M. D7500. When the final boiling point is greater than that specified in the standard, the true boiling point distribution can be determined by extrapolation. A particular form of the recycle solvent has a true boiling point distribution having an initial boiling point ≥130° C. and a final boiling point ≤566° C.; and/or contains ≥15 wt % of two ring and/or three ring aromatic compounds.

A tar-fluid mixture is produced by combining a pyrolysis tar, e.g., SCT, with a sufficient amount of a utility fluid comprising recycle solvent (together with a sufficient amount of recycle solvent in the utility fluid) for the tar-fluid mixture to have a viscosity that is sufficiently low for the tar-fluid mixture to be conveyed to hydroprocessing, e.g., a 50° C. kinematic viscosity of the tar-fluid mixture that is ≤500 cSt. When the utility fluid comprises ≥50 wt. % of recycle solvent, e.g., ≥75 wt. %, such as ≥90 wt. %, or ≥95 wt. %, or 50 wt. % 99 wt. %, the amounts of utility fluid and pyrolysis tar in the tar-fluid mixture to achieve such a viscosity are generally in the range from about 20 wt % to about 95 wt % of the pyrolysis tar and from about 5 wt % to about 80 wt % of the utility fluid, based on total weight of tar-fluid mixture. For example, the relative amounts of utility fluid and pyrolysis tar in the tar-fluid mixture can be in the range of (i) about 20 wt % to about 90 wt % of the pyrolysis tar and about 10 wt % to about 80 wt % of the utility fluid, or (ii) from about 40 wt % to about 90 wt % of the pyrolysis tar and from about 10 wt % to about 60 wt % of the utility fluid. The utility fluid:pyrolysis tar weight ratio is typically ≥0.01, e.g., in the range of 0.05 to 4.0, such as in the range of 0.1 to 3.0, or 0.3 to 1.1. In certain aspects, particularly when the pyrolysis tar contains a representative SCT, the tar-fluid mixture can contain 50 wt % to 70 wt % of pyrolysis tar, with ≥90 wt % of the balance of the tar-fluid mixture containing the specified utility fluid, e.g., ≥95 wt %, such as ≥99 wt. Although the utility fluid can be combined with the pyrolysis tar to produce the tar-fluid mixture within the hydroprocessing stage, it is typical to combine them upstream of the hydroprocessing, e.g., by adding utility fluid to the pyrolysis tar.

Figure 2:
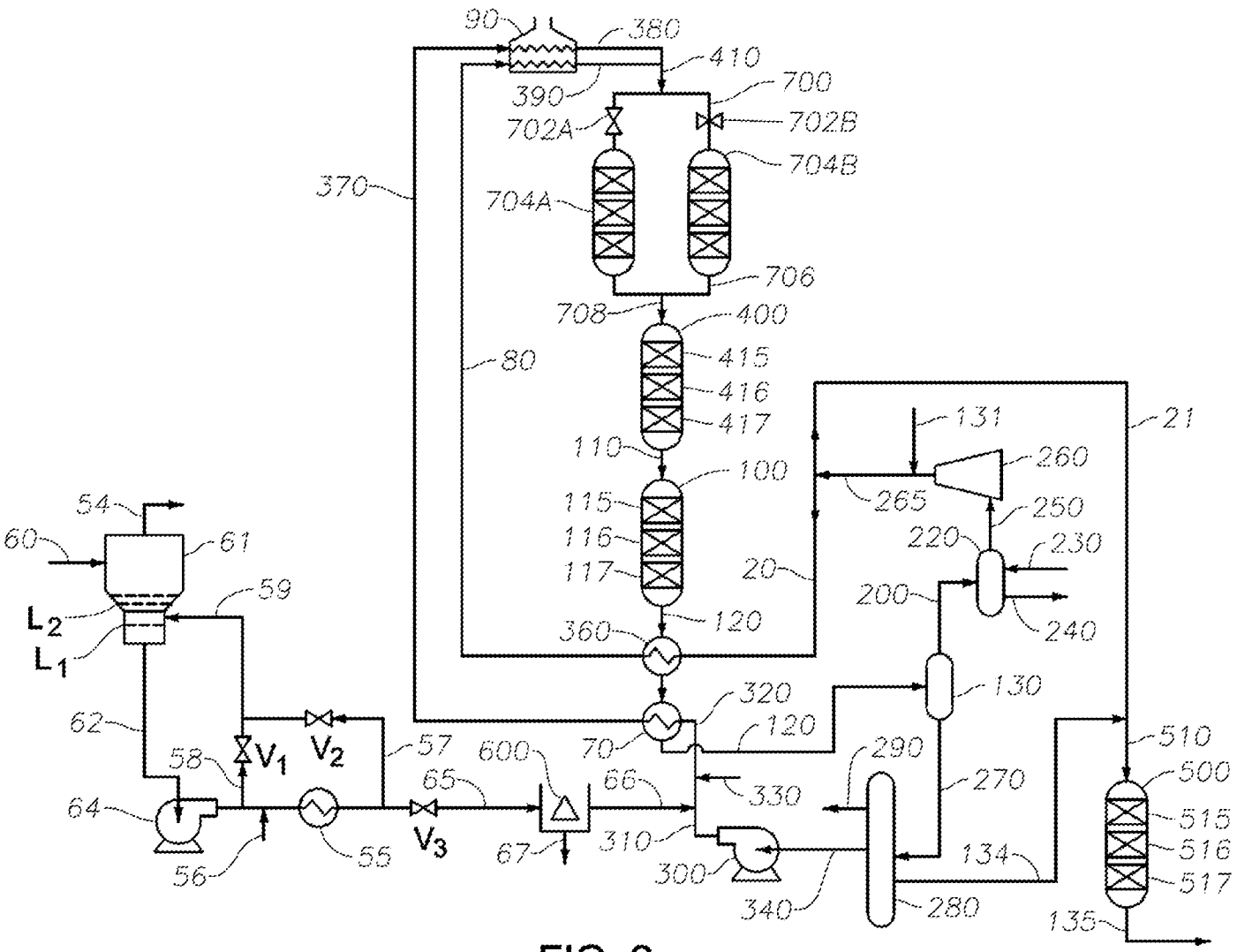
FIG. 2 depicts a more detailed schematic of the tar processing process according to one or more embodiments.
Figure 3:
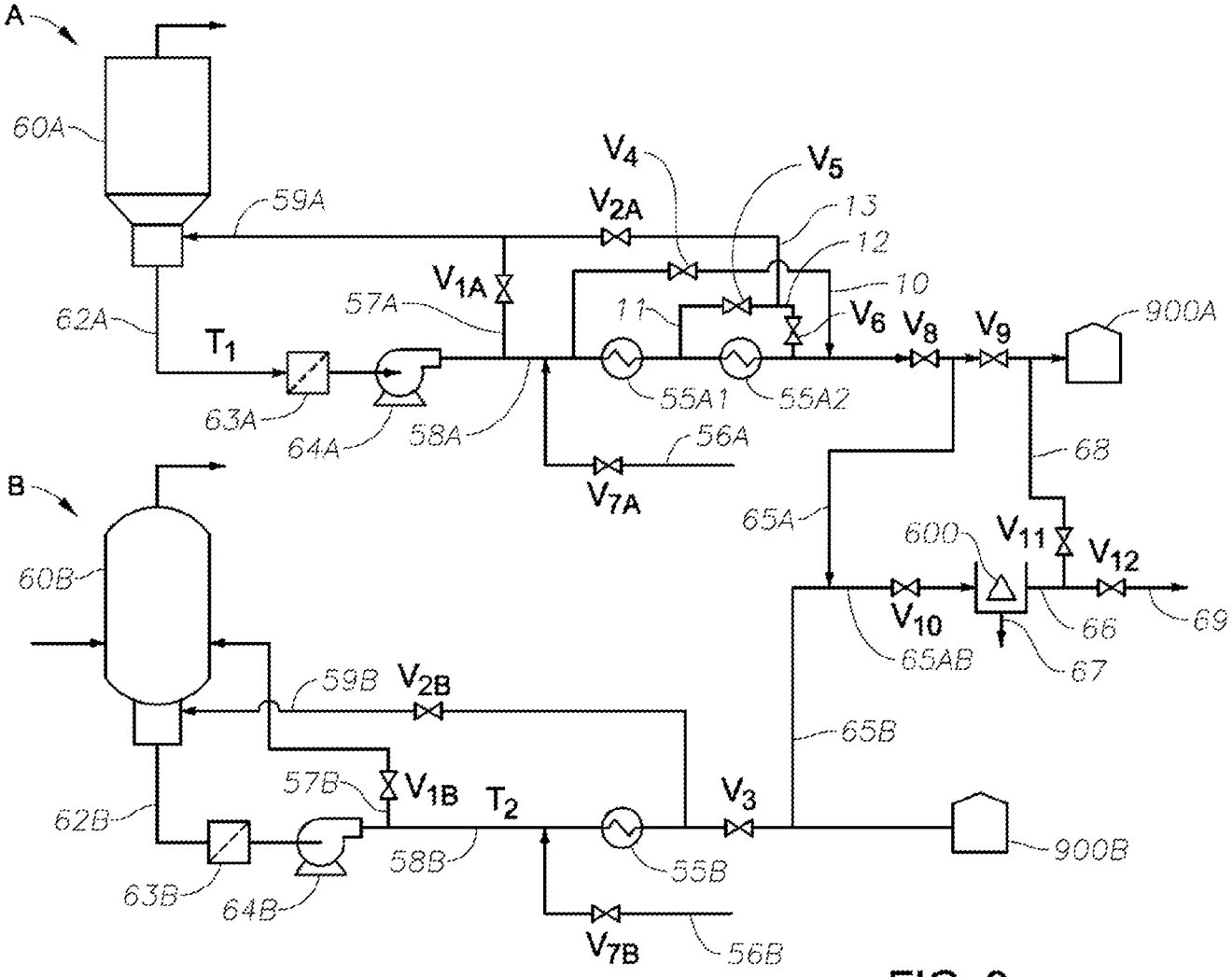
FIG. 3 depicts an alternative cold tar-recycle arrangement that can be used for heat soaking the tar feed, in which tar produced by two different upstream processes can be treated, according to one or more embodiments.

In one or more embodiments, the utility fluid can be or include one or more recycle solvents or fluids, such as the stream coming from line J depicted in FIG. 1 and/or line 56 in FIGS. 2 and 3. The utility fluid can be combined with the tar being processed during a heat soaking process that reduces the reactivity of the tar, as depicted FIGS. 2 and 3, line 56 ("optional flux" inlet). In some embodiments, utility fluid is added to the tar after a heat soaking process has been applied to the tar and before the process stream is fed into a solids-removal step, as depicted in FIG. 1, line J.

Typically, the tar is combined with the utility fluid to produce a tar-fluid mixture. Mixing of compositions containing hydrocarbons can result in precipitation of certain solids, for example asphaltenes, from the mixture. Hydrocarbon compositions that produce such precipitates upon mixing are said to be "incompatible." Creating an incompatible mixture can be avoided by mixing only compositions such that the "solubility blending number", $S_{BN}$, of all of the components of the mixture is greater than the "insolubility number", $I_N$, of all of the components of the mixture. Determining $S_{BN}$ and $I_N$ and so identifying compatible mixtures of hydrocarbon compositions is described in U.S. Pat. No. 5,997,723, incorporated by reference herein in its entirety.

In certain aspects, the process includes treating (e.g., by mild hydroprocessing) a tar-fluid mixture in a guard reactor, and then carrying out the pretreatment under Pretreatment Hydroprocessing Conditions, where the feed to the pretreater includes at least a portion of the guard reactor's effluent, e.g., a major amount of the guard reactor's effluent, such as substantially all of the guard reactor's effluent. These aspects typically feature one or more of (i) a utility fluid having an $S_{BN}$≥120, such as ≥125, ≥130, ≥135, or ≥140; (ii) a pyrolysis tar having an $I_N$≥70, e.g., ≥80; and (iii)≥70 wt % of the pyrolysis tar resides in compositions having an atmospheric boiling point ≥290° C., e.g., ≥80 wt %, or ≥90 wt %. The tar-fluid mixture can have, e.g., an $S_{BN}$≥110, such as ≥120, or ≥130. It has been found that there is a beneficial decrease in reactor plugging, particularly in the guard reactor and/or pretreater, when the tar feed has an $I_N$≥110 provided that, after being combined with the recycle solvent or utility fluid, the feed has an $S_{BN}$≥150, ≥155, or ≥160. The pyrolysis tar can have a relatively large $I_N$, e.g., $I_N$≥80, especially ≥100, or ≥110, provided the utility fluid has relatively large $S_{BN}$, e.g., ≥100, ≥120, or ≥140.

An SCT upgrading process will now be described in more detail with reference to FIGS. 1-3. Although the process is described in terms of SCT, this description is not meant to foreclose the use of other tars besides or in addition to SCT, e.g., other pyrolysis tars. Conventional SCT can be used (SCT produced by a conventional steam cracking process), but the invention is not limited thereto.

The upgrading process includes steps of SCT hydroprocessing, typically such that a later step of hydroprocessing is conducted under similar or more severe conditions than an earlier step of hydroprocessing. Thus, at least one stage of hydroprocessing under "Pretreatment Hydroprocessing Conditions", is used to lower the reactivity of the tar or of the tar-utility fluid mixture. The pretreatment hydroprocessing is typically carried out after hydroprocessing in one or more guard reactors (D1 and D2 in FIG. 1), but before a stage of hydroprocessing that is carried out under Intermediate Hydroprocessing Conditions (G in FIG. 1). The intermediate hydroprocessing typically effects the major part of hydrogenation and some desulfurizing reactions. Pretreatment Hydroprocessing Conditions are less severe than "Intermediate Hydroprocessing Conditions". For example, compared to Intermediate Hydroprocessing Conditions, Pretreatment Hydroprocessing Conditions utilize one or more of a lesser hydroprocessing temperature, a lesser hydroprocessing pressure, a greater tar+utility fluid feed weight hourly space velocity ("WHSV"), a greater SCT WHSV, and a lesser molecular hydrogen consumption rate. Within the parameter ranges (T, P, and/or WHSV) specified for Pretreatment Hydroprocessing Conditions, particular hydroprocessing conditions can be selected to achieve a desired 566° C.+ conversion, typically in the range from 0.5 wt % to 5 wt % substantially continuously for at least ten days.

Optionally, the process includes at least one stage of retreatment hydroprocessing (L in FIG. 1), especially to further lessen sulfur content of the intermediate hydroprocessed tar. Retreatment hydroprocessing is carried out under "Retreatment Hydroprocessing Conditions" after at least one stage of hydroprocessing under Intermediate Hydroprocessing Conditions. Typically, the retreatment hydroprocessing is carried out with little or no utility fluid. The Retreatment Hydroprocessing Conditions are typically more severe than the Intermediate Hydroprocessing Conditions, When a temperature is indicated for particular catalytic hydroprocessing conditions in a hydroprocessing zone, e.g., Pretreatment, Intermediate, and Retreatment Hydroprocessing Conditions, this refers to the average temperature of the hydroprocessing zone's catalyst bed (one half the difference between the bed's inlet and outlet temperature). When the hydroprocessing reactor contains more than one hydroprocessing zone (e.g., as shown in FIG. 2) the hydroprocessing temperature is the average temperature in the hydroprocessing reactor, e.g., (one half the difference between the temperature of the most upstream catalyst bed's inlet and the temperature of the most downstream catalyst bed's outlet temperature).

Total pressure in each of the hydroprocessing stage is typically regulated to maintain a flow of SCT, SCT composition, pretreated tar, hydroprocessed tar, and retreated tar from one hydroprocessing stage to the next, e.g., with little or need for inter-stage pumping. Although it is within the scope of the invention for any of the hydroprocessing stages to operate at an appreciably greater pressure than others, e.g., to increase hydrogenation of any thermally-cracked molecules, this is not required. The invention can be carried out using a sequence of total pressure from stage-to-stage that is sufficient (i) to achieve the desired amount of tar hydroprocessing, (ii) to overcome any pressure drops across the stages, and (iii) to maintain tar flow to the process, from stage-to-stage within the process, and away from the process.

A: Thermal Treatment

Formation of coke precursors during SCT hydroprocessing leads to an increase in hydroprocessing reactor fouling. It has been observed that coke precursor formation results mainly from two reactions: inadequate hydrogenation of thermally cracked molecules and polymerization of highly reactive molecules in the SCT. Although inadequate hydrogenation can be addressed by increasing the reactor pressure, the polymerizations of highly reactive molecules depend not only on pressure, but mainly on other conditions such as temperature and weight hourly space velocity ("WHSV"). Accordingly, certain aspects of the invention relate to carrying out SCT hydroprocessing with less reactor fouling by (i) thermally-treating the tar which produces a tar composition having a lesser reactivity, (ii) hydroprocessing of the thermally-treated tar in the presence of a utility fluid comprising recycle solvent to form a pretreater effluent, and (iii) hydroprocessing of the pretreater effluent to produce a hydroprocessed tar.

Reactivities, such as SCT reactivity $R_T$, SCT composition reactivity $R_C$, and reactivity of the tar-fluid mixture $R_M$, have been found to be well-correlated with the tar's olefin content, especially the content of styrenic hydrocarbons and dienes. While not wishing to be bound by any particular theory, it is believed that the SCT's olefin compounds (i.e., the tar's olefin components) have a tendency to polymerize during hydroprocessing, leading to the formation of coke precursors that are capable of plugging or otherwise fouling the reactor. Fouling is more prevalent in the absence of hydrogenation catalysts, such as in the preheater and dead volume zones of a hydroprocessing reactor. Certain measures of a tar's olefin content, e.g., BN, have been found to be well-correlated with the tar's reactivity. Reactivities such as $R_T$, $R_C$, and $R_M$ can therefore be expressed in BN units, i.e., the amount of bromine (as $Br_2$) in grams consumed (e.g., by reaction and/or sorption) by 100 grams of a tar sample. Bromine Index ("BI") can be used instead of or in addition to BN measurements, where BI is the amount of $Br_2$ mass in mg consumed by 100 grams of tar.

SCT reactivity can be measured using a sample of the SCT withdrawn from a SCT source, e.g., bottoms of a flash drum separator, a tar storage tank, or any combination thereof. The sample is combined with sufficient utility fluid to achieve a predetermined 50° C. kinematic viscosity in the tar-fluid mixture, typically ≤500 cSt. Although the BN measurement can be carried out with the tar-fluid mixture at an elevated temperature, it is typical to cool the tar-fluid mixture to a temperature of about 25° C. before carrying out the BN measurement. Methods for measuring BN of a heavy hydrocarbon can be used for determining SCT reactivity, or that of a tar-fluid mixture, but the invention is not limited to using these. For example, BN of a tar-fluid mixture can be determined by extrapolation from conventional BN methods as applied to light hydrocarbon streams, such as electrochemical titration, e.g., as specified in A.S.T.M. D-1159; colorimetric titration, as specified in A.S.T.M. D-1158; and Karl Fischer titration. The titration can be carried out on a tar sample having a temperature ≤ambient temperature, e.g., ≤25° C. Although the cited A.S.T.M. standards are indicated for samples of lesser boiling point, it has been found that they are also applicable to measuring SCT BN.

Certain aspects of the process include thermally-treating a tar to produce a thermally-treated tar (a tar composition, e.g., a SCT composition), combining the tar composition with utility fluid, e.g., utility fluid comprising recycle solvent, to produce a tar-fluid mixture, hydroprocessing the tar-fluid mixture under Pretreatment Hydroprocessing Conditions to produce a pretreater effluent, and hydroprocessing at least part of the pretreatment effluent under Intermediate Hydroprocessing Conditions to produce a hydroprocessor effluent containing hydroprocessed tar. For example, the process can include thermally treating a SCT to produce a SCT composition, combining the SCT composition with a specified amount of a specified utility fluid comprising recycle solvent to produce a tar-fluid mixture, hydroprocessing the tar-fluid mixture in a pretreatment reactor under Pretreatment Hydroprocessing Conditions, to produce a pretreater effluent, and hydroprocessing at least a portion of the pretreater effluent under Intermediate Hydroprocessing.

In addition to its high density and high sulfur content, tar (particularly pyrolysis tar such as SCT) is very reactive because it contains a significant amount of reactive olefins, such as vinyl naphthalenes, and/or acenaphthalenes. In some embodiments, uncontrolled oligomerization reactions lead to fouling in a preheater and/or a reactor when tar is heated, e.g., to temperatures greater than 250° C. The higher the temperature, the more severe the fouling. In the present process, the tar feed is subjected to an initial, controlled heat-soaking step to oligomerize olefins in the tar and thereby decrease the reactivity of the tar during further processing. Certain aspects of the thermal treatment (e.g., heat soaking) are described below in more detail with respect to a representative SCT.

Thermally treating a tar to reduce its reactivity can be accomplished in a cold tar recycling process with some minor modification, e.g., by reducing the flow of cold tar back into the process as described further below. Thermal treatment kinetics suggests that a reaction temperature of 200° C. to 300° C. with a residence time of a few minutes, e.g., 2 min, to ≥30 min, is effective in reducing tar reactivity. The higher the thermal treating temperature, the shorter the thermal treatment reaction time or residence time can be. For example, at 300° C., a residence time of 2-5 min may be adequate. At 250° C., a residence time of about 30 min gives similar reduction in reactivity. Pressure has little impact on thermal treatment kinetics and so the thermal treatment can be performed at ambient pressure or at the pressure of the outlet of the tar knockout process feeding the tar upgrading process.

Typically, tar reactivity is ≥30 BN, e.g., in the range from 30 BN to as high as 40 BN or greater. A target reactivity of 28 BN or lower is set for reduced reactivity tar in order to decrease (or even minimize) fouling in the guard reactor and/or pretreater, which typically utilizes a hydroprocessing temperature in the range from 260° C. to 300° C. Providing a heat-soaked tar (a tar composition of reactivity $R_C$) in the form of a reduced reactivity tar as feed to the guard reactor operating in the specified guard reactor temperature range for guard reactor hydroprocessing typically results in little if any fouling of the guard reactor for typical hydroprocessing run durations. Tar dilution with utility fluid (as a solvent or flux) should be minimized prior to or during heat soaking. In some instances it may be necessary to inject utility fluid to improve tar flow characteristics during and after heat soaking. However, excessive dilution with utility fluid, particularly utility fluid comprising recycle solvent, leads to much slower reduction in tar reactivity during thermal treatments such as heat soaking, e.g., as indicated by the tar's BN. Thus, it is desirable that the amount of utility fluid utilized used for viscosity reduction during thermal treatment (heat soaking) be controlled to ≤10 wt % based on the combined weight of tar and the utility fluid.

FIG. 2 includes an exemplary cold tar recycle system (e.g., elements upstream of the centrifuge element 600). FIG. 3 shows an alternative arrangement of the cold tar recycle system in which tar streams from two separate upstream processes are recycled separately and then can be combined for solids removal and subsequent downstream processing.

Cold tar recycle is designed to reduce tar residence time at high temperature, such as at a tar knockout drum temperature, which is typically around 300° C. In existing tar disposition, cold tar recycle is implemented to reduce oligomerization to minimize increase in asphaltene content, which requires addition of expensive flux, such as steam cracked gas oil, in order to be blended into HSFO. In order to heat soak tar to reduce tar BN, cold tar recycle is minimized, e.g., by lowering the recycle tar flow rate, to increase tar temperature and also increase residence time. By reducing the cold tar recycle to a flow rate of 0 to 100 tons per hour, heat soaking is carried out in a temperature range from 200° C. to 300° C., typically 250° C. to 280° C., for a heat soaking time in the range from 2 to 15 minutes. Additional heat soaking, in which the tar is held at elevated temperatures, such as 150° C. or higher, for an extended time, e.g., from 0.5 hours to 2 hours, should reduce the BN even further, for example to 25, or 23, or less but may for certain tars, e.g., certain SCTs, lead to an IC increase. In certain aspects, the thermal treatment is carried out at a temperature in the range from 20° C. to 300° C., or from 200° C. to 250° C. or from 225° C. to 275° C., for a time in the range from 2 to 30 min, e.g., 2 to 5 min, or 5 to 20 min, or 10 to 20 min. At higher temperatures, the heat soaking can suitably be performed for a shorter period of time.

For representative tars, e.g., representative pyrolysis tars, such as representative SCTs, it is observed that the specified thermal treatment, e.g., the specified neat soaking carried out by cold tar recycle, decreases one or more of $R_T$, $R_C$, and $R_M$. Typically, the thermal treatment is carried out using a SCT feed of reactivity $R_T$ to produce a SCT composition having a lesser reactivity=$R_C$. Conventional thermal treatments are suitable for heat treating SCT, including heat soaking, but the invention is not limited thereto. Although reactivity can be improved by blending the SCT with a second pyrolysis tar of lesser olefinic hydrocarbon content, it is more typical to improve $R_T$ (and hence $R_M$) by thermal treatment of the SCT. It is believed that the specified thermal treatment is particularly effective for decreasing the tar's olefin content. For example, combining a thermally-treated SCT with the specified utility fluid in the specified relative amounts typically produces a tar-fluid mixture having an $R_M$≤18 BN. If substantially the same SCT is combined with substantially the same utility fluid in substantially the same relative amounts without thermally-treating the tar, the tar-fluid mixture typically has an $R_M$ in the range from 19 BN to 35 BN.

One representative pyrolysis tar is an SCT ("SCT1") having an $R_T$≥28 BN (on a tar basis), such as $R_T$ of about 35; a density at 15° C. that is ≥1.10 g/cm$^3$; a 50° C. kinematic viscosity in the range of ≥1.0×10$^4$ cSt; an $I_N$≥80; wherein ≥70 wt % of SCT1's hydrocarbon components have an atmospheric boiling point of ≥290° C. SCT1 can be obtained from an SCT source, e.g., from the bottoms of a separator drum (such as a tar drum) located downstream of steam cracker effluent quenching. The thermal treatment can include maintaining SCT1 to a temperature in the range from $T_1$ to $T_2$ for a time ≥$t_{HS}$. $T_1$ is ≥150° C., e.g., ≥160° C., such as ≥170° C., or ≥180° C., or ≥190° C., or ≥200° C. $T_2$ is ≤320° C., e.g., ≤310°, such as ≤300° C., or ≤290° C., and $T_2$ is ≥$T_1$. Generally, $t_{HS}$ is ≥1 min, e.g., ≥10 min, such as ≥100 min, or typically in the range from 1 min to 400 min. Provided $T_2$ is ≤320° C., utilizing a $t_{HS}$ of ≥10 min, e.g., ≥50 min, such as ≥100 min typically produces a treated tar having better properties than those treated for a lesser $t_{HS}$.

Although the present disclosure is not so limited, the heating can be carried out in a lower section of the tar drum and/or in SCT piping and equipment associated with the tar knock out drum. For example, it is typical for a tar drum to receive quenched steam cracker effluent containing SCT. While the steam cracker is operating in pyrolysis mode, SCT accumulates in a lower region of the tar drum, from which the SCT is continuously withdrawn. A portion of the withdrawn SCT can be reserved for measuring one or more of $R_T$ and $R_M$. The remainder of the withdrawn SCT can be conducted away from the tar drum and divided into two separate SCT streams. At least a portion of the first stream (a recycle portion) is recycled to the lower region of the tar drum. At least a recycle portion of the second stream is also recycled to the lower region of the tar drum, e.g., separately or together with the recycle portion of the first stream. Typically, ≥75 wt % of the first stream resides in the recycled portion, e.g., ≥80 wt %, or ≥90 wt %, or ≥95 wt %. Typically, ≥40 wt % of the second stream resides in the recycled portion, e.g., ≥50 wt %, or ≥60 wt %, or ≥70 wt %. Optionally, a storage portion is also divided from the second stream, e.g., for storage in tar tanks. Typically, the storage portion is ≥90 wt % of the remainder of the second stream after the recycle portion is removed. The thermal treatment temperate range and $t_{HS}$ can be controlled by regulating flow rates to the tar drum of the first and/or second recycle streams.

Typically, the recycle portion of the first stream has an average temperature that is no more than 60° C. below the average temperature of the SCT in the lower region of the tar drum, e.g., no more than 50° C. below, or no more than 25° C. below, or no more than 10° C. below. This can be achieved, e.g., by thermally insulating the piping and equipment for conveying the first stream to the tar drum. The second stream, or the recycle portion thereof, is cooled to an average temperature that is (i) less than that of the recycle portion of the first stream and (ii) at least 60° C. less than the average temperature of the SCT in the lower region of the tar drum, e.g., at least 70° C. less, such as at least 80° C. less, or at least 90° C. less, or at least 100° C. less. This can be achieved by cooling the second stream, e.g., using one or more heat exchangers. Utility fluid can be added to the second stream as a flux if needed. If utility fluid comprising recycle solvent is added to the second stream, the amount of added utility fluid is taken into account when additional utility fluid is combined with SCT to produce a tar-fluid mixture to achieve a desired tar:fluid weight ratio within the specified range.

The thermal treatment is typically controlled by regulating (i) the weight ratio of the recycled portion of the second stream:the withdrawn SCT stream and (ii) the weight ratio of the recycle portion of the first stream:recycle portion of the second stream. Controlling one or both of these ratios has been found to be effective for maintaining and average temperature of the SCT in the lower region of the tar drum in the desired ranges of $T_1$ to $T_2$ for a treatment time $t_{HS} \geq 1$ minute. A greater SCT recycle rate corresponds to a greater SCT residence time at elevated temperature in the tar drum and associated piping, and typically increases the height of the tar drum's liquid level (the height of liquid SCT in the lower region of the tar drum, e.g., proximate to the boot region). Typically, the ratio of the weight of the recycled portion of the second stream to the weight of the withdrawn SCT stream is ≤0.5, e.g., ≤0.4, such as ≤0.3, or ≤0.2, or in the range from 0.1 to 0.5. Typically, the weight ratio of the recycle portion of the first stream:recycle portion of the second stream is ≤5, e.g., ≤4, such as ≤3, or ≤2, or ≤1, or ≤0.9, or ≤0.8, or in the range from 0.6 to 5. Although it is not required to maintain the average temperature of the SCT in the lower region of the tar drum at a substantially constant value ($T_{HS}$), it is typical to do so. $T_{HS}$ can be, e.g., in the range from 150° C. to 320° C., such as 160° C. to 3100, or ≥170° C. to 300° C. In certain aspects, the thermal treatment conditions include (i) $T_{HS}$ is at least 10° C. greater than $T_1$ and (ii) $T_{HS}$ is in the range of 150° C. to 320° C. For example, typical $T_{HS}$ and $t_{HS}$ ranges include 180° C.≤$T_{HS}$≤320° C. and 5 minutes ≤$t_{HS}$≤100 minutes; e.g., 200° C.≤$T_{HS}$≤280° C. and 5 minute ≤$t_{HS}$≤30 minutes. Provided $T_{HS}$ is ≤320° C., utilizing a $t_{HS}$ of ≥10 min, e.g., ≥50 min, such as ≥100 min typically produces a better treated tar over those produced at a lesser $t_{HS}$.

The specified thermal treatment is effective for decreasing the representative SCTs $R_T$ to achieve an $R_C \leq R_T - 0.5$ BN, e.g., $R_C \leq R_T - 1$ BN, such as $R_C \leq R_T - 2$ BN, or $R_C \leq R_T - 4$ BN, or $R_C \leq R_T - 8$ BN. Since $R_C \leq 18$ BN, $R_M$ is typically ≤18 BN, e.g., ≤17 BN, such as 12 BN<$R_M$≤18 BN. In certain aspects, the thermal treatment results in the tar-fluid mixtures having an $R_M \leq 17$ BN, e.g., ≤16 BN, such as ≤12 BN, or ≤10 BN, or ≤8 BN. Carrying out the thermal treatment at a temperature in the specified temperature range of $T_1$ to $T_2$ for the specified time $t_{HS} \geq 1$ minute is beneficial in that the treated tar (the SCT composition) has an insolubles content ("$IC_C$") that is less than that of a treated tar obtained by thermal treatments carried out at a greater temperature. This is particularly the case when $T_{HS}$ is ≤320° C., e.g., ≤300° C., such as ≤250° C., or ≤200° C., and $t_{HS}$ is ≥10 minutes, such as ≥100 minutes. The favorable $IC_C$ content, e.g., ≤6 wt %, and typically ≤5 wt %, or ≤3 wt %, or ≤2 wt %, increases the suitability of the thermally-treated tar for use as a fuel oil, e.g., a transportation fuel oil, such as a marine fuel oil. It also decreases the need for solids-removal before hydroprocessing. Generally, $IC_C$ is about the same as or is not appreciably greater ICT. $IC_C$ typically does not exceed $IC_T$+3 wt %, e.g., $IC_C \leq IC_T$+2 wt %, such as $IC_C \leq IC_T$+1 wt %, or $IC_C \leq IC_T$+0.1 wt %.

Although it is typical to carry out SCT thermal treatment in one or more tar drums and related piping, the invention is not limited thereto For example, when the thermal treatment includes heat soaking, the heat soaking can be carried out at least in part in one or more soaker drums and/or in vessels, conduits, and other equipment (e.g., fractionators, water-quench towers, indirect condensers) associated with, e.g., (i) separating the SCT from the pyrolysis effluent and/or (ii) conveying the SCT to hydroprocessing. The location of the thermal treatment is not critical. The thermal treatment can be carried out at any convenient location, e.g., after tar separation from the pyrolysis effluent and before hydroprocessing, such as downstream of a tar drum and upstream of mixing the thermally treated tar with recycle solvent or utility fluid.

In certain aspects, the thermal treatment is carried out as illustrated schematically in FIG. 2. As shown, quenched effluent from a steam cracker furnace facility is conducted via line 60 to a tar knock out drum 61. Cracked gas is removed from the drum via line 54. SCT condenses in the lower region of the drum (the boot region as shown), and a withdrawn stream of SCT is conducted away from the drum via line 62 to pump 64. A filter (not shown in the figure) for removing large solids, e.g., ≥10,000 μm diameter, from the SCT stream may be included in the line 62. After pump 64, a first recycle stream 58 and a second recycle stream 57 are diverted from the withdrawn stream. The first and second recycle streams are combined as recycle to drum 61 via line 59. One or more heat exchangers 55 is provided for cooling the SCT in lines 57 (shown) and 65 (not shown) e.g., against water. Line 56 provides an optional flux of utility fluid if needed. Valves $V_1$, $V_2$, and $V_3$ regulate the amounts of the withdrawn stream that are directed to the first recycle stream, the second recycle stream, and a stream conducted to solids separation, represented here by centrifuge 600, via line 65. Lines 58, 59, and 62 can be insulated to maintain the temperature of the SCT within the desired temperature range for the thermal treatment. The thermal treatment time $t_{HS}$ can be increased by increasing SCT flow through valves $V_1$ and $V_2$, which raises the SCT liquid level in drum 61 from an initial level, e.g., $L_1$, toward $L_2$.

Thermally-treated SCT is conducted through valve $V_3$ and via line 65 toward a solids removal facility, here a centrifuge 600, and then the liquid fraction from the centrifuge is conveyed via line 66 to a hydroprocessing facility containing at least one hydroprocessing reactor. Solids removed from the tar are conducted away from the centrifuge via line 67. In the aspects illustrated in FIG. 2 using a representative SCT such as SCT1, the average temperature $T_{HS}$ of the SCT during thermal treatment in the lower region of tar drum (below $L_2$) is in the range from 200° C. to 275° C., and heat exchanger 55 cools the recycle portion of the second stream to a temperature in the range from 60° C. to 80° C. Time $t_{HS}$ can be, e.g., ≥10 min, such as in the range from 10 min to 30 min, or 15 min to 25 min.

In continuous operation, the SCT conducted via line 65 typically contains ≥50 wt % of SCT available for processing in drum 61, such as SCT, e.g., ≥75 wt %, such as ≥90 wt %.

In certain aspects, substantially all of the SCT available for hydroprocessing is combined with the specified amount of the specified utility fluid to produce a tar-fluid mixture which is conducted to hydroprocessing. Depending, e.g., on hydroprocessor capacity limitations, a portion of the SCT in line 65 or line 66 can be conducted away, such as for storage or further processing, including storage followed by hydroprocessing (not shown).

FIG. 3 shows an alternative arrangement in which tars from two separate pyrolysis processes can be heat soaked in separate recycling processes and then combined for solids removal. A first process A includes a separation in a tar knockout drum 60A. The lights are removed overhead of the drum, as shown, e.g., for further separation in at least one fractionator. A bottoms fraction containing a pyrolysis tar is removed from a tar knock-out drum 60A located downstream of a steam cracker. The bottoms fraction is removed via line 62A through a filter 63A for removal of large solids, e.g., ≥10,000 μm diameter, to pump 64A. After pump 64A, a first recycle stream 13 and a second recycle stream 57A (which bypasses the heat exchangers in stream 58A) are diverted from the withdrawn stream. The first recycle stream is passed through a heat exchanger 55A1 and optionally one or more further heat exchangers 55A2 before recombining with stream 57A via lines 12 and 13 as recycle to drum 61A via line 59A. Heat exchanger(s) 55A2 can be bypassed via lines 11 and 13 and appropriate configuration of valves V5 and V6. Both of heat exchangers 55A1 and 55A2 can be bypassed and the thermally processed tar stream can be conducted to downstream process steps via line 10 and appropriate configuration of valves V4, V5 and V6. Thermally processed tar from process A can be sent to downstream process steps via line 65A and/or to storage (in tank 900A) by appropriate configuration of valves V8 and V9. The proportion of recycle through the heat exchangers and bypassing them can be regulated by appropriate configuration of valves V1A and V2A. Line 56A and valve V7A can be configured to provide an optional flux of utility fluid if needed. A second process B includes a pyrolysis step includes a separation by fractionation, e.g., in a primary fractionator 60B. The lights are removed overhead of the primary fractionator as shown, e.g., to a secondary fractionator. The bottoms of fractionator 60B containing a pyrolysis tar, is removed from primary fractionator 60B via line 62B through a filter 63B for removal of large solids, e.g., ≥10,000 μm diameter, to pump 64B. After pump 64B, a first recycle stream 59B and a second recycle stream 57B (which bypasses the heat exchangers in stream 58B) are diverted from the withdrawn stream. The first recycle stream is passed through a heat exchanger 55B and optionally one or more further heat exchangers (not shown) before recycling to the bottoms collector of the fractionator 60B via line 59B through valve V2B. The second recycle stream recycles via valve V1B to the fractionator. The proportion of recycle through the primary fractionator and through the fractionator bottoms collector is regulated by appropriate configuration of valves V1B and V2B. Line 56B and valve V7B can be configured to provide an optional flux of utility fluid if needed. Valve V3 controls the flow from the thermal treatment process to the solids removal facility (here centrifuge 600), via line 65B and/or to storage (in tank 900B).

In the thermal treatment of the tar produced in process A, a temperature T1 is shown, and the temperature of the thermal treatment of the tar produced in process B is shown as T2. T1 and T2 can be the same or different, and are chosen appropriately for the particular tar to be thermally treated and the desired residence time for the thermal treatment. For example, T1 for a pyrolysis tar obtained from a tar knockout drum might be 250° C. or so, and T2, for a pyrolysis tar obtained from the bottoms of a primary fractionator, might be 280° C. or so.

In FIG. 3, lines 58A, 58B, 59A, 59B, and 62A and 62B can be insulated to maintain the temperature of the SCT within the desired temperature range for the thermal treatment. Downstream of the joinder of lines 65A and 65B, valve V10 regulates the amounts of the thermally processed tar that is fed to a solids removal step; here solids are removed by the centrifuge 600.

B: Centrifugation

Tar such as SCT, contains 1,000 ppmw to up to 4,000 ppmw or even greater amounts of insolubles in the form of particulate solids. The particles are believed to have two origins. The first source is coke fines arising from pyrolysis. The coke fines from pyrolysis typically have very low hydrogen content, e.g., ≤3 wt %, and a density ≥1.2 g/ml. The second source is from tar oligomerization or polymer coke. There are multiple points in the steam cracking process that polymer coke can form and enter the tar stream. For example, some steam crackers have significant fouling issues in a primary fractionator. The source of this fouling is believed to result from polymers forming in the fractionator tower via vinyl aromatics oligomerization at temperatures ≤150° C. Although it is conventional to periodically remove foulant from fractionator trays by hydro-blasting, some foulant becomes entrained in the tar stream via the quench oil recycle. This foulant, identified herein as polymer coke, is richer in hydrogen content, e.g., ≥5 wt %, and typically has lower density, e.g., ≤1.1 g/ml, than pyrolysis coke fines.

In addition to the two main sources of coke fines, a tertiary fines source is believed to result from the specified heat soaking. Accordingly it is within the scope of the invention to carry out the heat soaking under relatively mild conditions (lower temperature, shorter time durations) within the specified heat soaking conditions. Compared to solids produced by other pathways, solids produced during tar heat soaking are believed to have a relatively large hydrogen content (e.g., ≥5 wt %), and are believed to have much smaller particle sizes, e.g., ≤25 μm.

In certain aspects, centrifugation (typically assisted by the utility fluid) is used for solids removal. For example, solids can be removed from the tar-fluid mixture at a temperature in the range from 80° C. to 100° C. using a centrifuge. Any suitable centrifuge may be used, including those industrial-scale centrifuges available from Alfa Laval. The feed to the centrifuge may be a tar-fluid mixture containing utility fluid comprising recycle solvent and a tar composition (thermally-treated tar). The amount of utility fluid is controlled such that the density of tar-fluid mixture at the centrifugation temperature, typically 50° C. to 120° C., or from 60° C. to 100° C., or from 60° C. to 90° C., is substantially the same as the desired feed density (1.02 g/ml to 1.06 to g/ml at 80° C. to 90° C.). Typically, the utility fluid contains, comprises, consists essentially of, or even consists of a recycle solvent recovered from a mid-cut stream separated from a product of tar hydroprocessing. The amount of utility fluid in the tar-fluid mixture is typically around 40 wt % for a wide variety of pyrolysis tars, but can vary, for example from 20% to 60%, so as to provide the feed at a desired density, which may be pre-selected.

Continuing with FIG. 2, the thermally treated tar stream is conducted via line 65 through valve V3 into a centrifuge 600. The liquid product is conducted via line 66 storage and/or the specified hydroprocessing. At least a portion of solids removed during centrifuging are conducted away via line 67, e.g., for storage or further processing.

Similarly in FIG. 3, the thermally treated tar stream from process A via line 65A and the thermally treated tar stream from process B via line 65B are combined in line 65AB and conducted to the centrifuge 600 via valve V10. The liquid product is conducted via lines 66 and 69 to downstream hydroprocessing facilities. The solid product is removed via line 67, which can be conducted away. Line 68 conveys the centrifuge liquid product to storage. Allocation of the centrifuge liquid product to storage or to further downstream processing is controlled by configuration of valves V11 and V12.

The centrifuge is effective in removing particulates from the feed, particularly those of size ≥25 μm. The amount of particles ≥25 μm in the centrifuge effluent is typically less than 2 vol. % of all the particles. Tar, e.g., pyrolysis tar, such as SCT, typically contains a relatively large concentration of particles having a size ≤25 μm. For representative tars, the amount of solids generally ranges from 100 ppm to 170 ppm with a median concentration of about 150 ppm. A majority of the solids in each tar is in the form of particles having a size of ≤25 μm. Particles of such size are carried through the process without significant fouling.

Following the removal of solids, the tar stream is subject to additional processes to further lower the reactivity of the tar before hydroprocessing under Intermediate Hydroprocessing Conditions. These additional processes are collectively called "pretreatment" and include pretreatment hydroprocessing in a guard reactor and then further additional hydroprocessing in an Intermediate Hydroprocessing reactor.

C: Guard Reactor

A guard reactor 704 (e.g., 704A, 704B in FIG. 2) is used to protect downstream reactors from fouling from reactive olefins and solids, e.g., by decreasing tar reactivity and decreasing fouling by any particulates in centrifuge effluent. Doing so lessens the amount of fouling in a pretreater and other hydroprocessing stages located downstream of the guard reactor. This can be beneficial when a further decrease in tar reactivity is needed, e.g., $R_C$<27 BN. In one or more configurations (illustrated in FIGS. 1 and 2), two guard reactors are run in alternating mode—one on-line with the other off-line. When one of the guard reactors exhibits an undesirable increase in pressure drop, it is brought off-line so that it can be serviced and restored to condition for continued guard reactor operation. Restoration while off-line can be carried out, e.g., by replacing reactor packing and replacing or regenerating the reactor's internals, including catalyst. A plurality of (online) guard reactors can be used. Although the guard reactors can be arranged serially (not shown), it is more typical for at least two guard reactors to be arranged in parallel, as in FIGS. 2 and 3.

Referring again to FIG. 2, a thermally treated tar composition having solids ≥25 μm substantially removed is conducted via line 66 for processing in at least one guard reactor. This composition is combined with recovered utility fluid comprising recycle solvent supplied via line 310 to produce the tar-fluid mixture in line 320. Optionally, a supplemental recycle solvent or utility fluid, may be added via conduit 330. A first pre-heater 70 preheats the tar-fluid mixture (which typically is primarily in liquid phase), and the pre-heated mixture is conducted to a supplemental pre-heating stage 90 via conduit 370. Supplemental pre-heater stage 90 can be, e.g., a fired heater. Recycled treat gas is obtained from conduit 265 and, if necessary, is mixed with fresh treat gas, supplied through conduit 131. The treat gas is conducted via conduit 20 through a second pre-heater 360, before being conducted to the supplemental pre-heat stage 90 via conduit 80. Fouling in the Intermediate Hydroprocessing reactor 110 can be decreased by increasing feed pre-heater duty in pre-heaters 70 and 90.

Continuing with reference to FIG. 2, the pre-heated tar-fluid mixture (from line 380) is combined with the pre-heated treat gas (from line 390) and then conducted via line 410 to guard reactor inlet manifold 700. Mixing means (not shown) can be utilized for combining the pre-heated tar-fluid mixture with the pre-heated treat gas in guard reactor inlet manifold 700. The guard reactor inlet manifold directs the combined tar-fluid mixture and treat gas to online guard reactors, e.g., 704A, via an appropriate configuration of guard reactor inlet valves 702A, shown open, and 702B shown closed. An offline guard reactor 704B is illustrated, which can be isolated from the pretreatment inlet manifold by the closed valve 702B and a second isolation valve (not shown) downstream of the outlet of reactor 704B. On-line reactor 704A can also be brought off-line, and isolated from the process, when reactor 704B is brought on-line. Reactors 704A and 704B are typically brought off-line in sequence (one after the other) so that one 704A or 704B is on-line while the other is off-line, e.g., for regeneration. Effluent from the online guard reactor(s) is conducted to further downstream processes via a guard reactor outlet manifold 706 and line 708.

The guard reactor is operated under guard reactor hydroprocessing conditions. Typically, these conditions include a temperature in the range from 200° C. to 300° C., more typically 200° C. to 280° C., or 250° C. to 280° C., or 250° C. to 270° C., or 260° C. to 300° C.; a total pressure in the range from 1,000 psia-1,600 psia; typically 1,300 psia to 1,500 psia, a space velocity, such as weight hourly space velocity ("WHSV"), in the range from 5 $hr^{-1}$ to 7 $hr^{-1}$. The guard reactor contains a catalytically-effective amount of at least one hydroprocessing catalyst. Typically, upstream beds of the reactor include at least one catalyst having demetallization activity, e.g., relatively large-pore catalysts to capture metals in the feed. Beds located further downstream in the reactor typically contain at least one catalyst having activity for olefin saturation, e.g., catalyst containing Ni and/or Mo. The guard reactor typically receives as feed a tar-fluid mixture having a reactivity $R_M$≤18 BN on a feed basis, where the tar component of the tar-fluid mixture has an $R_T$ and/or $R_C$≤30 BN, such as ≤28 BN, on a tar basis.

D: Pretreatment Hydroprocessor

A pretreatment hydroprocessor can be used downstream of the guard reactor to lessen foulant accumulation in the reactor G. As shown in FIG. 1, when the pretreater effluent, e.g., the effluent of pretreater F in FIG. 1, has a reactivity of 17 BN, reactor G exhibits an appreciable dP in about 20 days. When the reactivity of reactor F's effluent is in the range from 12 BN to 15 BN, the run length of reactor G increased from 20 days to more than 3 months.

Certain forms of the pretreatment hydroprocessing reactor will now be described with continued reference to FIG. 2. In these aspects, the tar-fluid mixture is hydroprocessed under the specified Pretreatment Hydroprocessing Conditions described below to produce a pretreatment hydroprocessor (pretreater) effluent. The invention is not limited to these aspects, and this description is not meant to foreclose other aspects within the broader scope of the invention.

Pretreatment Hydroprocessing Conditions

The SCT composition is combined with utility fluid comprising recycle solvent to produce a tar-fluid mixture that is hydroprocessed in pretreater hydroprocessor in the presence of molecular hydrogen under Pretreatment Hydroprocessing Conditions to produce a pretreatment hydroprocessing reactor effluent. The pretreatment hydroprocessing is typically carried out in at least one hydroprocessing zone (415, 416, 417) located in at least one pretreatment hydroprocessing reactor 400. The pretreatment hydroprocessing reactor can be in the form of a conventional hydroprocessing reactor, but the invention is not limited thereto.

The pretreatment hydroprocessing is carried out under Pretreatment Hydroprocessing Conditions, to further lower the reactivity of the tar stream (tar-utility fluid stream) after the thermal treatment (e.g., by heat soaking) step and an initial stage of pretreatment in the guard reactor. Pretreatment Hydroprocessing Conditions include temperature $T_{PT}$, total pressure $P_{PT}$, and space velocity $WHSV_{PT}$. One or more of these parameters are typically different from those of the intermediate hydroprocessing ($T_I$, $P_I$, and/or $WHSV_I$). Pretreatment Hydroprocessing Conditions typically include one or more of $T_{PT} \geq 150°$ C., e.g., ≥200° C. but less than $T_1$ (e.g., $T_{PT} \leq T_1 - 10°$ C., such as $T_{PT} \leq T_1 - 25°$ C., such as $T_{PT} \leq T_1 - 50°$ C.), a total pressure $P_{PT}$ that is ≥8 MPa but less than $P_I$, $WHSV_{PT} \geq 0.3$ $hr^{-1}$ and greater than $WHSV_I$ (e.g., $WHSV_{PT} \geq WHSV_I + 0.01$ $hr^{-1}$, such as $\geq WHSV_I + 0.05$ $hr^{-1}$, or $\geq WHSV_I + 0.1$ $hr^{-1}$, or $\geq WHSV_I + 0.5$ $hr^{-1}$, or $\geq WHSV_I + 1$ $hr^{-1}$, or $\geq WHSV_I + 10$ $hr^{-1}$, or more), and a molecular hydrogen consumption rate that in the range from 150 standard cubic meters of molecular hydrogen per cubic meter of the pyrolysis tar (S $m^3/m^3$) to about 400 S $m^3/m^3$ (845 SCF/B to 2250 SCF/B) but less than that of intermediate hydroprocessing. The Pretreatment Hydroprocessing Conditions typically include $T_{PT}$ in the range from 260° C. to 300° C.; $WHSV_{PT}$ in the range from 1.5 $hr^{-1}$ to 3.5 $hr^{-1}$, e.g., 2 $hr^{-1}$ to 3 $hr^{-1}$; a $P_{PT}$ in the range from 6 MPa to 13.1 MPa; a molecular hydrogen supply rate in a range of about 600 standard cubic feet per barrel of tar-fluid mixture (SCF/B) (107 S $m^3/m^3$) to 1,000 SCF/B (178 S $m^3/m^3$), and a molecular hydrogen consumption rate in the range from 300 standard cubic feet per barrel of the pyrolysis tar composition in the tar-fluid mixture (SCF/B) (53 S $m^3/m^3$) to 400 SCF/B (71 S $m^3/m^3$).

Pretreatment hydroprocessing is carried out in the presence of hydrogen, e.g., by (i) combining molecular hydrogen with the tar-fluid mixture upstream of the pretreatment hydroprocessing, and/or (ii) conducting molecular hydrogen to the pretreatment hydroprocessing reactor in one or more conduits or lines. Although relatively pure molecular hydrogen can be utilized for the hydroprocessing, it is generally desirable to use a "treat gas" which contains sufficient molecular hydrogen for the pretreatment hydroprocessing and optionally other species (e.g., nitrogen and light hydrocarbons such as methane) which generally do not adversely interfere with or affect either the reactions or the products. The treat gas optionally contains ≥about 50 vol. % of molecular hydrogen, e.g., ≥75 vol. %, such as ≥90 wt %, based on the total volume of treat gas conducted to the pretreatment hydroprocessing stage.

Typically, the pretreatment hydroprocessing in at least one hydroprocessing zone of the pretreatment hydroprocessing reactor is carried out in the presence of a catalytically-effective amount of at least one catalyst having activity for hydrocarbon hydroprocessing. Conventional hydroprocessing catalysts can be utilized for pretreatment hydroprocessing, such as those specified for use in resid and/or heavy oil hydroprocessing. Suitable pretreatment hydroprocessing catalysts include bulk metallic catalysts and supported catalysts. The metals can be in elemental form or in the form of a compound.

Typically, the tar-fluid mixture in the guard reactor effluent fed to the pretreatment hydroprocessing reactor is primarily in the liquid phase during the pretreatment hydroprocessing. For example, ≥75 wt % of the tar-fluid mixture is in the liquid phase during the hydroprocessing, such ≥90 wt %, or ≥99 wt %. The pretreatment hydroprocessing produces a pretreater effluent which at the pretreatment reactor's outlet includes (i) a primarily vapor-phase portion including unreacted treat gas, primarily vapor-phase products derived from the treat gas and the tar-fluid mixture, e.g., during the pretreatment hydroprocessing, and (ii) a primarily liquid-phase portion which includes pretreated tar-fluid mixture, unreacted recycle solvent or utility fluid, and products, e.g., cracked products, of the pyrolysis tar and/or utility fluid as may be produced during the pretreatment hydroprocessing. The liquid-phase portion (namely the pretreated tar-fluid mixture which contains the pretreated pyrolysis tar) typically further contains insolubles and has a reactivity ($R_F$)≤12 BN, e.g., ≤11 BN, such as ≤10 BN.

Certain aspects of the pretreatment hydroprocessing will now be described in more detail with respect to FIG. 2. As shown in the figure, guard reactor effluent flows from the guard reactor via line 708 to the pretreatment reactor 400. The guard reactor effluent can be mixed with additional treat gas (not shown); the additional treat gas can also be preheated. Mixing means (not shown) can be utilized for combining the guard reactor effluent with the pre-heated treat gas in pretreatment reactor 400, e.g., one or more gas-liquid distributors of the type conventionally utilized in fixed bed reactors.

The pretreatment hydroprocessing is carried out in the presence of hydroprocessing catalyst(s) located in at least one catalyst bed 415. Additional catalyst beds, e.g., 416, 417, may be connected in series with catalyst bed 415, optionally with intercooling using treat gas from conduit 20 being provided between beds (not shown). Pretreater effluent is conducted away from pretreatment reactor 400 via conduit 110.

In certain aspects, the following Pretreatment Hydroprocessing Conditions are used to achieve the target reactivity (in BN) in the pretreater effluent: $T_{PT}$ in the range from 250° C. to 325° C., or 275° C. to 325° C., or 260° C. to 300° C.; or 280° C. to 300° C.; $WHSV_{PT}$ in the range from 2 $hr^{-1}$ to 3 $hr^{1}$, $P_{PT}$ in the range from 1,000 psia to 1,600 psia, e.g., 1,300 psia to 1,500 psia; and total pressure; a treat gas rate in the range from 600 SCF/B to 1,000 SCF/B, or 800 SCF/B to 900 SCF/B (on a feed basis). Under these conditions, the pretreater effluent's reactivity is typically ≤12 BN.

E: Intermediate Hydroprocessing

Referring again to FIG. 1, hydroprocessing reactor G (the Intermediate Hydroprocessing reactor) is used for carrying out most of the desired tar-conversion reactions, including hydrogenating and first desulfurizing reactions. Reactor G adds approximately 800 SCF/B to 2,000 SCF/B, of molecular hydrogen to the feed, e.g., approximately 1,000 SCF/B to 1,500 SCF/B, most of which is added to tar rather than to the recycle solvent or utility fluid.

The first set of tar-conversion reactions can be used to reduce the size of tar molecules, particularly the size of TH. Doing so leads to a significant reduction in the tar's 1,050° F.+fraction. Hydrodesulfurization (HDS) can be used to desulfurize the tar. For SCT, few alkyl chains survive the steam cracking—most molecules are dealkylated. As a result, the sulfur-containing molecules, e.g., benzothiophene or dibenzothiophenes, generally contain exposed sulfurs. These sulfur-containing molecules are readily removed using one or more conventional hydroprocessing catalysts, but the invention is not limited thereto. Suitable conventional catalysts include those containing one or more of Ni, Co, and Mo on a support, such as aluminate ($Al_2O_3$). Another tar-conversion reaction can be used, and these typically include hydrogenation followed by ring opening to further reduce the size of tar molecules. Aromatics saturation reactions can also be used. Adding hydrogen to any of the products from these reactions has been found to improve the quality of the hydroprocessed tar.

In certain aspects, intermediate hydroprocessing of at least a portion the pretreated tar-fluid mixture is carried out in reactor G under Intermediate Hydroprocessing Conditions, e.g., to effect at least hydrogenation and desulfurization. This intermediate hydroprocessing will now be described in more detail.

Intermediate Hydroprocessing of the Pretreated Tar-Fluid Mixture

In certain aspects not shown in FIG. 2, liquid and vapor portions are separated from the pretreater effluent. The vapor portion is upgraded to remove impurities such as sulfur compounds and light paraffinic hydrocarbon, and the upgraded vapor can be re-cycled as treat gas for use in one or more of hydroprocessing reactors 704A, 704B, 400, 100, and 500. The separated liquid portion can be conducted to a hydroprocessing stage operating under Intermediate Hydroprocessing Conditions to produce a hydroprocessed tar. Additional processing of the liquid portion, e.g., solids removal, can be used upstream of the intermediate hydroprocessing.

In other aspects, as shown in FIG. 2, the entire effluent of the pretreater is conducted away from reactor 400 via line 110 for intermediate hydroprocessing of the entire pretreatment hydroprocessing effluent in an Intermediate Hydroprocessing reactor 100 (Reactor G in FIG. 1). It will be appreciated by those skilled in the art, that for a wide range of conditions within the Pretreatment Hydroprocessing Conditions and for a wide range of tar-fluid mixtures, sufficient molecular hydrogen will remain in the pretreatment hydroprocessing effluent for the intermediate hydroprocessing of the pretreated tar-fluid mixture in Intermediate Hydroprocessing reactor 100 without need for supplying additional treat gas, e.g., from the conduit 20.

Typically, the intermediate hydroprocessing in at least one hydroprocessing zone of the Intermediate Hydroprocessing reactor is carried out in the presence of a catalytically-effective amount of at least one catalyst having activity for hydrocarbon hydroprocessing. The catalyst can be selected from among the same catalysts specified for use in the pretreatment hydroprocessing. For example, the intermediate hydroprocessing can be carried out in the presence of a catalytically effective amount hydroprocessing catalyst(s) located in at least one catalyst bed 115. Additional catalyst beds, e.g., 116, 117, may be connected in series with catalyst bed 115, optionally with intercooling using treat gas from conduit 60 being provided between beds (not shown). The intermediate hydroprocessed effluent is conducted away from the Intermediate Hydroprocessing reactor 100 via line 120.

The intermediate hydroprocessing is carried out in the presence of hydrogen, e.g., by one or more of (i) combining molecular hydrogen with the pretreatment effluent upstream of the intermediate hydroprocessing (not shown), (ii) conducting molecular hydrogen to the Intermediate Hydroprocessing reactor in one or more conduits or lines (not shown), and (iii) utilizing molecular hydrogen (such as in the form of unreacted treat gas) in the pretreatment hydroprocessing effluent.

Typically, the Intermediate Hydroprocessing Conditions include $T_I$>400° C., e.g., in the range from 300° C. to 500° C., such as 350° C. to 430° C., or 350° C. to 420° C., or 360° C. to 420° C., or 360° C. to 410° C.; and a $WHSV_I$ in the range from 0.3 $hr^{-1}$ to 20 $hr^{-1}$ or 0.3 $hr^{-1}$ to 10 $hr^{-}$, based on the weight of the pretreated tar-fluid mixture subjected to the intermediate hydroprocessing. It is also typical for the Intermediate Hydroprocessing Conditions to include a molecular hydrogen partial pressure during the hydroprocessing ≥8 MPa, or ≥9 MPa, or ≥10 MPa, although in certain aspects it is ≤14 MPa, such as ≤13 MPa, or ≤12 MPa. For example, $P_I$ can be in the range from 6 MPa to 13.1 MPa. Generally, $WHSV_I$ is ≥0.5 $hr^{-1}$, such as ≥1.0 $hr^{-1}$, or alternatively ≤5 $hr^{-1}$, e.g., ≤4 $hr^{-1}$, or ≤3 $hr^{-1}$. The amount of molecular hydrogen supplied to a hydroprocessing stage operating under Intermediate Hydroprocessing Conditions is typically in the range from about 1,000 SCF/B (standard cubic feet per barrel) (178 S $m^3/m^3$) to 10,000 SCF/B (1,780 S $m^3/m^3$), in which B refers to barrel of pretreated tar-fluid mixture that is conducted to the intermediate hydroprocessing. For example, the molecular hydrogen can be provided in a range from 3,000 SCF/B (534 S $m^3/m^3$) to 5,000 SCF/B (890 S $m^3/m^3$). The amount of molecular hydrogen supplied to hydroprocess the pretreated pyrolysis tar component of the pretreated tar-fluid mixture is typically less than would be the case if the pyrolysis tar component was not pretreated and contained greater amounts of olefin, e.g., $C_{6+}$ olefin, such as vinyl aromatics. The molecular hydrogen consumption rate during Intermediate Hydroprocessing Conditions is typically in the range of 350 standard cubic feet per barrel (SCF/B, which is about 62 standard cubic meters/cubic meter (S $m^3/m^3$)) to about 1,500 SCF/B (267 S $m^3/m^3$), where the denominator represents barrels of the pretreated pyrolysis tar, in the range of about 1,000 SCF/B (178 S $m^3/m^3$) to 1,500 SCF/B (267 S $m^3/m^3$), or about 2,200 SCF/B (392 S $m^3/m^3$) to 3,200 SCF/B (570 S $m^3/m^3$).

Within the parameter ranges (T, P, and/or WHSV) specified for Intermediate Hydroprocessing Conditions, particular hydroprocessing conditions for a particular pyrolysis tar are typically selected to (i) achieve the desired 566° C.+ conversion, typically ≥20 wt % substantially continuously for at least ten days, and (ii) produce a TLP and hydroprocessed pyrolysis tar having the desired properties, e.g., the desired density and viscosity. The term 566° C.+ conversion means the conversion during hydroprocessing of pyrolysis tar compounds having boiling a normal boiling point ≥566° C. to compounds having boiling points ≤566° C. This 566° C.+ conversion includes a high rate of conversion of THs, resulting in a hydroprocessed pyrolysis tar having desirable properties.

The hydroprocessing can be carried out under Intermediate Hydroprocessing Conditions for a significantly longer duration without significant reactor fouling (e.g., as evidenced by no significant increase in reactor dP during the desired duration of hydroprocessing, such as a pressure drop of ≤140 kPa during a hydroprocessing duration of 10 days, typically ≤70 kPa, or ≤35 kPa) than is the case under substantially the same hydroprocessing conditions for a tar-fluid mixture that has not been pretreated. The duration of hydroprocessing without significantly fouling is typically least 10 times longer than would be the case for a tar-fluid mixture that has not been pretreated, e.g., ≥100 times longer, such as ≥1,000 times longer.

In certain aspects, Intermediate Hydroprocessing Conditions include a $T_I$ in the range from 320° C. to 500° C., 320° C. to 450° C., 340° C. to 425° C., 360° C. to 410° C., 375° C. to 410° C., equal to or greater than 350° C. to 500° C., 350° C. to 475° C., 350° C. to 450° C., 350° C. to 425° C., 350° C. to 400° C., 380° C. to 500° C., 380° C. to 475° C., 380° C. to 450° C., 380° C. to 425° C., 380° C. to 400° C., or 400° C. to 450° C.; $P_I$ in the range from 1,000 psi to 1,600 psi, typically 1,300 psi to 1,500 psi; $WHSV_I$ in the range from 0.5 $hr^{-1}$ to 1.2 $hr^{-1}$, typically 0.7 $hr^{-1}$ to 1 $hr^{-1}$, or 0.6 $hr^{-1}$ to 0.8 $hr^{-1}$, or 0.7 $hr^{-1}$ to 0.8 $hr^{-1}$; and a treat gas rate in the range from 2,000 SCF/B to 6,000 SCF/B, or 2,500 SCF/B to 5,500 SCF/B, or 3,000 SCF/B to 5,000 SCF/B (feed basis). Feed to the Intermediate Hydroprocessing reactor typically has a reactivity <12 BN. The weight ratio of tar:utility fluid in the feed to the Intermediate Hydroprocessing reactor is typically in the range from 50 to 80:50 to 20, typically 60:40. Typically the intermediate hydroprocessing (hydrogenating and desulfurizing) adds from 1,000 SCF/B to 2,000 SCF/B of molecular hydrogen (feed basis) to the tar, and can reduce the sulfur content of the tar by ≥80 wt %, e.g., ≥95 wt %, or in the range from 80 wt % to 90 wt %.

Figure 4:
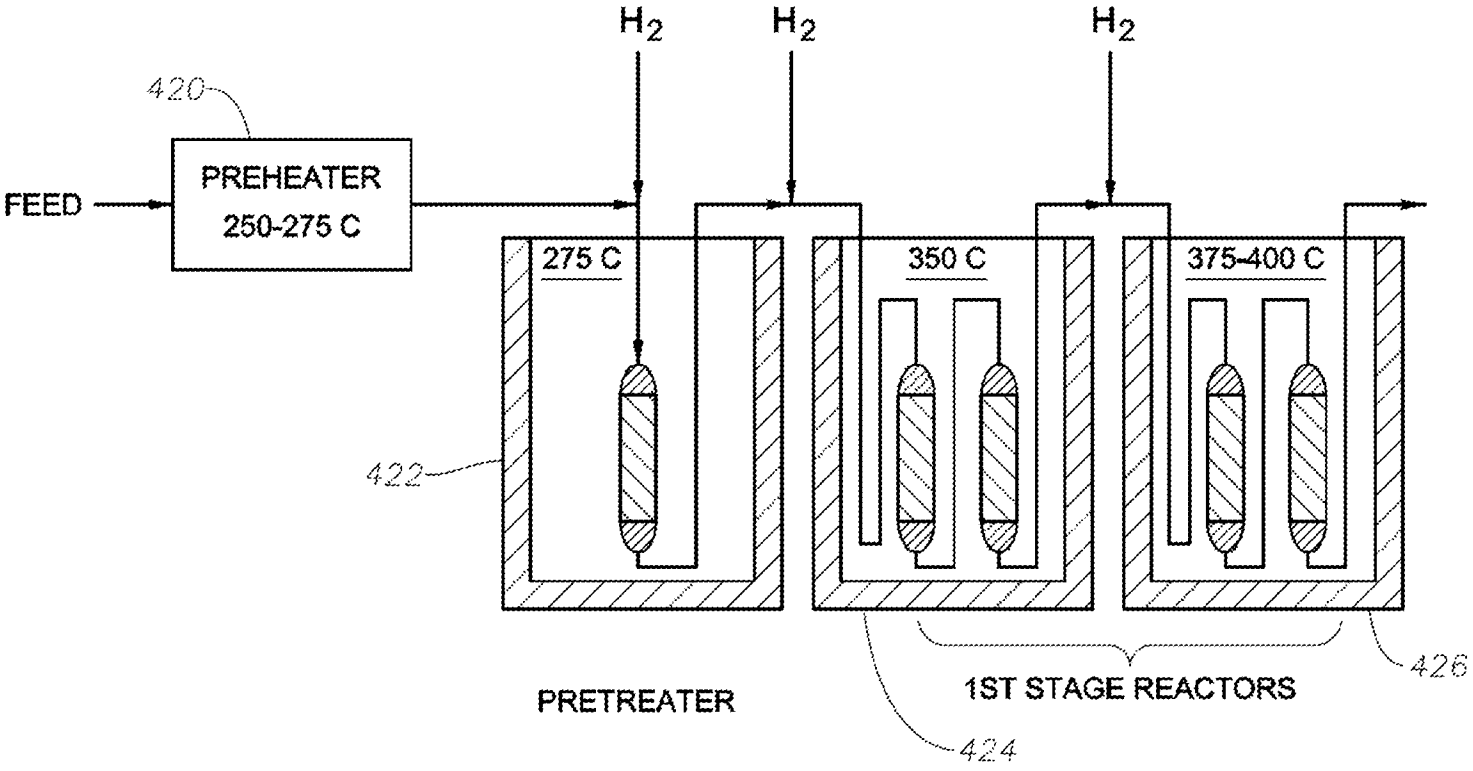
FIG. 4 depicts a configuration of a pretreater and several reactors that can be used in a hydroprocessing process, according to one or more embodiments.

In one or more embodiments, FIG. 4 depicts a configuration of a preheater 420, a pretreater 422, and several reactors 424, 426 that can be used in the hydroprocessing processes discussed and described herein. In one or more examples, the hydroprocessing of the lower viscosity, reduced reactivity tar can include heating the lower viscosity, reduced reactivity tar to a temperature of about 250° C. to about 275° C. in the preheater 420 and then heating the lower viscosity, reduced reactivity tar to a temperature of about 260° C. to about 300° C. in the pretreater 422 containing hydrogen. The hydrogen can be flowed into the preheater 420 at about 500 standard cubic feet per barrel (SCFB) to about 1,500 SCFB, 700 SCFB to about 1,200 SCFB, or about 800 SCFB to about 1,000 SCFB, such as about 900 SCFB. Thereafter, the lower viscosity, reduced reactivity tar can be heated to a temperature of about 325° C. to about 375° C. in a first reactor 424 containing hydrogen. The hydrogen can be flowed into the first reactor 424 at about 800 SCFB to about 2,000 SCFB, 1,200 SCFB to about 1,800 SCFB, or about 1,400 SCFB to about 1,600 SCFB, such as about 1,500 SCFB.

Thereafter, the lower viscosity, reduced reactivity tar can be heated to a temperature of about 360° C. to about 450° C. in a second reactor 426 containing hydrogen. The hydrogen can be flowed into the second reactor 426 at about 200 SCFB to about 1,000 SCFB, 400 SCFB to about 800 SCFB, or about 500 SCFB to about 700 SCFB, such as about 600 SCFB. In one or more examples, the lower viscosity, reduced reactivity tar is heated to a temperature of about 270° C. to about 280° C. in the pretreater 422, then heated to a temperature of about 340° C. to about 360° C. in a first reactor 424, and then heated to a temperature of about 375° C. to about 400° C. in a second reactor 426.

F: Recovering the Intermediate Hydroprocessed Pyrolysis Tar

Referring again to FIG. 2, the hydroprocessor effluent is conducted away from the Intermediate Hydroprocessing reactor 100 via line 120. When the second and third preheaters (360 and 70) are heat exchangers, the hot hydroprocessor effluent in conduit 120 can be used to preheat the tar/utility fluid and the treat gas respectively by indirect heat transfer. Following this optional heat exchange, the hydroprocessor effluent is conducted to separation stage 130 for separating total vapor product (e.g., heteroatom vapor, vapor-phase cracked products, unused treat gas, or any combination thereof) and TLP from the hydroprocessor effluent. The total vapor product is conducted via line 200 to upgrading stage 220, which typically includes, e.g., one or more amine towers. Fresh amine is conducted to stage 220 via line 230, with rich amine conducted away via line 240. Regenerated treat gas is conducted away from stage 220 via line 250, compressed in compressor 260, and conducted via lines 265, 20, and 21 for re-cycle and re-use in the Intermediate Hydroprocessing reactor 100 and optionally in the $2^{nd}$ hydroprocessing reactor 500.

The TLP from separation stage 130 typically contains hydroprocessed pyrolysis tar, e.g., ≥10 wt % of hydroprocessed pyrolysis tar, such as ≥50 wt %, or ≥75 wt %, or ≥90 wt %. The TLP optionally contains non-tar components, e.g., hydrocarbon having a true boiling point range that is substantially the same as that of the utility fluid (e.g., unreacted recycle solvent or utility fluid). The TLP is useful as a diluent (e.g., a flux) for heavy hydrocarbons, especially those of relatively high viscosity. Optionally, all or a portion of the TLP can substitute for more expensive, conventional diluents. Non-limiting examples of blendstocks suitable for blending with the TLP and/or hydroprocessed tar include one or more of bunker fuel; burner oil; heavy fuel oil, e.g., No. 5 and No. 6 fuel oil; high-sulfur fuel oil; low-sulfur fuel oil; regular-sulfur fuel oil (RSFO); gas oil as may be obtained from the distillation of crude oil, crude oil components, and hydrocarbon derived from crude oil (e.g., coker gas oil), and the like. For example, the TLP can be used as a blending component to produce a fuel oil composition containing ≤0.5 wt % sulfur. Although the TLP is an improved product over the pyrolysis tar feed, and is a useful blendstock "as-is", it is typically beneficial to carry out further processing.

In the aspects illustrated in FIG. 2, TLP from separation stage 130 is conducted via line 270 to a further separation stage 280, e.g., for separating from the TLP one or more of hydroprocessed pyrolysis tar, additional vapor, and at least one stream suitable for use as recycle as a utility fluid or a component of the utility fluid. Separation stage 280 may be, for example, a distillation column with side-stream draw although other conventional separation methods may be utilized. An overhead stream, a side stream and a bottoms stream, listed in order of increasing boiling point, are separated from the TLP in stage 280. The overhead stream (e.g., vapor) is conducted away from separation stage 280 via line 290. Typically, the bottoms stream conducted away via line 134 contains >50 wt % of hydroprocessed pyrolysis tar, e.g., ≥75 wt %, such as ≥90 wt %, or ≥99 wt %; and typically accounts for approximately 40 wt % of the main rector's (reactor 100) TLP, and typically about 67 wt % of tar feed.

At least a portion of the overhead and bottoms streams may be conducted away, e.g., for storage and/or for further processing. The bottoms stream of line 134 can be desirably used as a diluent (e.g., a flux) for heavy hydrocarbon, e.g., heavy fuel oil. When desired, at least a portion of the overhead stream 290 is combined with at least a portion of the bottoms stream 134 for a further improvement in properties. Optionally, separation stage 280 is adjusted to shift the boiling point distribution of side stream 340 so that side stream 340 has properties desired for the recycle solvent or utility fluid, e.g., (i) a true boiling point distribution having an initial boiling point ≥177° C. (350° F.) and a final boiling point ≤566° C. (1,050° F.) and/or (ii) an $S_{BN}$≥100, e.g., ≥120, such as ≥125, or ≥130. Optionally, trim molecules may be separated, for example, in a fractionator (not shown), from separation stage 280 bottoms and/or overhead and added to the side stream 340 as desired. The side stream (a mid-cut) is conducted away from separation stage 280 via conduit 340. At least a portion of the side stream 340 can be utilized as utility fluid and conducted via pump 300 and conduit 310. Typically, the side stream composition of line 310 (the mid-cut stream) is at least 10 wt % of the recycle solvent or utility fluid, e.g., ≥25 wt %, such as ≥50 wt %.

The hydroprocessed pyrolysis tar product from the intermediate hydroprocessing has desirable properties, e.g., a 15° C. density measured that is typically at least 0.10 g/cm$^3$ less than the density of the thermally-treated pyrolysis tar. For example, the hydroprocessed tar can have a density that is at least 0.12, or at least 0.14, or at least 0.15, or at least 0.17 g/cm$^3$ less than the density of the pyrolysis tar composition. The hydroprocessed tar's 50° C. kinematic viscosity is typically ≤1,000 cSt. For example, the viscosity can be ≤500 cSt, e.g., ≤150 cSt, such as ≤100 cSt, or ≤75 cSt, or ≤50 cSt, or ≤40 cSt, or ≤30 cSt. Generally, the intermediate hydroprocessing results in a significant viscosity improvement over the pyrolysis tar conducted to the thermal treatment, the pyrolysis tar composition, and the pretreated pyrolysis tar. For example, when the 50° C. kinematic viscosity of the pyrolysis tar (e.g., obtained as feed from a tar knock-out drum) is ≥1×10$^4$ cSt, e.g., ≥1×10$^5$ cSt, ≥1×10$^6$ cSt, or ≥1×10$^7$ cSt, the 50° C. kinematic viscosity of the hydroprocessed tar is typically ≤200 cSt, e.g., ≤150 cSt, ≤100 cSt, ≤75 cSt, ≤50 cSt, ≤40 cSt, or ≤30 cSt. Particularly when the pyrolysis tar feed to the specified thermal treatment has a sulfur content ≥1 wt %, the hydroprocessed tar typically has a sulfur content ≥0.5 wt %, e.g., in a range of about 0.5 wt % to about 0.8 wt %.

G: Utility Fluid Recovery

An advantage of the specified processes is that at least part of the utility fluid can be obtained from a recycle stream. Typically, ≥50 wt. %, e.g., 60 wt. % to 90 wt. %, such as 70 wt % to 85 wt % of the mid-cut stream from fractionator 280 is recycled as recycle solvent for use as the utility fluid or a utility fluid constituent. In certain aspects, the utility fluid comprises ≥50 wt. % recycle solvent, e.g., ≥60 wt. %, such as an amount in the range of from 60 wt. % to 90 wt. %, or 70 wt % to 85 wt % based on the weight of the utility fluid. When the amount of recycle solvent in the utility fluid is in the range of from about 50 wt. % to about 100 wt. %, the amount of utility fluid in the tar-fluid mixture is typically about 40 wt %, based on the weight of the tar-fluid mixture, but can range from 20 wt % to 50 wt %, or from 30 wt % to 45 wt %.

One or more distillation columns may be used to recover a mid-cut stream having the specified $S_{BN}$ for use as recycle solvent, typically $S_{BN}$≥110, e.g., ≥115, such as ≥120, or ≥140. Any separation method (e.g., fractionation) capable of providing recycle solvent having the desired composition can be used. Conventional separations can be used, but the invention is not limited thereto. An additional 20 wt % or so of recycle solvent (based on the total weight of recycle solvent employed as utility fluid) is generated in each cycle, mostly as a result of conversion during hydroprocessing of the tar's fraction having a normal boiling point ≥1,050° F. (566° C.). The additional recycle solvent produced by the process is used to replenish any overly-hydrogenated recycle solvent or utility fluid, which can be purged from the process together with a light stream in a distillation fractionator located downstream of the first stage main reactor. The recovered light stream contains a major amount of 1-ring and 2-ring aromatics. In general, molecules boiling at <400° F., with the majority of the composition boiling at 350° F. About 2 kilobarrels per day (kbd) of mid-cut can be drawn from the fractionators(s). Recovered recycle solvent that is not recycled to the tar upgrading process can be stored for other uses, e.g., blending into a refinery diesel stream. The light stream can also be recovered and stored or transported for further processing or other uses.

H: Retreatment Reactor to Further Reduce Sulfur

When it is desired to further improve properties of the hydroprocessed tar, e.g., by removing at least a portion of any sulfur remaining in hydroprocessed tar, an upgraded tar can be produced by optional retreatment hydroprocessing. Certain forms of the retreatment hydroprocessing will now be described in more detail with respect to FIG. 2. The retreatment hydroprocessing is not limited to these forms, and this description is not meant to foreclose other forms of retreatment hydroprocessing within the broader scope of the invention.

Referring again to FIG. 2, hydroprocessed tar (line 134) and treat gas (line 21) are conducted to retreatment reactor 500 via line 510. Retreatment reactor 500 is typically smaller than main reactor 100. Typically, the retreatment hydroprocessing in at least one hydroprocessing zone of the intermediate reactor is carried out in the presence of at least one catalyst having activity for hydrocarbon hydroprocessing. For example, the retreatment hydroprocessing can be carried out in the presence hydroprocessing catalysts located in one or more catalyst beds 515. Additional catalyst beds, e.g., 516, 517, may be connected in series with catalyst bed 515, optionally with intercooling, e.g., using treat gas from conduit 20, being provided between beds (not shown). A retreater effluent containing upgraded tar is conducted away from reactor 500 via line 135.

The description in this application is intended to be illustrative and not limiting of the invention. One in the skill of the art will recognize that variation in materials and methods used in the invention and variation of embodiments of the invention described herein are possible without departing from the invention. It is to be understood that some embodiments of the invention might not exhibit all of the advantages of the invention or achieve every object of the invention. The scope of the invention is defined solely by the claims following. Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

The invention claimed is:

1. A process for preparing a liquid hydrocarbon product comprising:

providing a reduced reactivity tar having a bromine number of no greater than 28;

blending the reduced reactivity tar with a utility fluid to produce a lower viscosity, reduced reactivity tar;

hydroprocessing the lower viscosity, reduced reactivity tar at a temperature of greater than 350° C. to produce a total liquids product (TLP) comprising the liquid hydrocarbon product and a recycle solvent;

separating the recycle solvent from the TLP, wherein the recycle solvent has a solubility blending number ($S_{BN}$) of greater than 110; and flowing the recycle solvent to the reduced reactivity tar for blending to produce the lower viscosity, reduced reactivity tar.

2. The process of claim 1, further comprising increasing the temperature of the lower viscosity, reduced reactivity tar during the hydroprocessing if the $S_{BN}$ of the recycle solvent is less than 115.

3. The process of claim 1, wherein the lower viscosity, reduced reactivity tar is hydroprocessed at a temperature of greater than 350° C. to about 500° C.

4. The process of claim 3, wherein the temperature is about 400° C. to about 450° C.

5. The process of claim 1, wherein the utility fluid comprises the recycle solvent, and wherein the $S_{BN}$ of the recycle solvent is greater than 110 to about 160.

6. The process of claim 1, wherein the $S_{BN}$ of the recycle solvent is greater than 120 to about 150.

7. The process of claim 6, wherein the $S_{BN}$ of the recycle solvent is about 130 to about 150.

8. The process of claim 1, further comprising centrifuging the lower viscosity, reduced reactivity tar to remove solids therefrom prior to hydroprocessing.

9. The process of claim 8, wherein after centrifuging, the lower viscosity, reduced reactivity tar is free of solids having a size of greater than 25 μm.

10. The process of claim 1, wherein the utility fluid comprises two-ring aromatics, three-ring aromatic, four-ring aromatics, or any combination thereof.

11. The process of claim 1, wherein the utility fluid comprises a solvent selected from the group consisting of benzene, ethylbenzene, trimethylbenzene, xylenes, toluene, naphthalenes, alkylnaphthalenes, tetralins, alkyltetralins, and any combination thereof.

12. The process of claim 1, wherein the hydroprocessing of the lower viscosity, reduced reactivity tar further comprises:

heating the lower viscosity, reduced reactivity tar to a temperature of about 260° C. to about 300° C. in a pretreater containing hydrogen; then heating the lower viscosity, reduced reactivity tar to a temperature of about 325° C. to about 375° C. in a first reactor containing hydrogen; then heating the lower viscosity, reduced reactivity tar to a temperature of about 360° C. to about 450° C. in a second reactor containing hydrogen.

13. A process for preparing a liquid hydrocarbon product comprising:

heat soaking a tar stream to produce a reduced reactivity tar having a bromine number of no greater than 28;

blending the reduced reactivity tar with a utility fluid to produce a lower viscosity, reduced reactivity tar;

centrifuging the lower viscosity, reduced reactivity tar to remove solids therefrom; then hydroprocessing the lower viscosity, reduced reactivity tar at a temperature of greater than 350° C. to produce a total liquids product (TLP) comprising the liquid hydrocarbon product and a recycle solvent;

separating the recycle solvent from the TLP, wherein the recycle solvent has a solubility blending number ($S_{BN}$) of greater than 115; and flowing the recycle solvent to the reduced reactivity tar for blending to produce the lower viscosity, reduced reactivity tar.

14. The process of claim 13, further comprising increasing the temperature of the lower viscosity, reduced reactivity tar during the hydroprocessing if the $S_{BN}$ of the recycle solvent is less than 120.

15. The process of claim 13, wherein the lower viscosity, reduced reactivity tar is hydroprocessed at a temperature of greater than 350° C. to about 500° C.

16. The process of claim 15, wherein the temperature is about 400° C. to about 450° C.

17. The process of claim 13, wherein the utility fluid comprises the recycle solvent, and wherein the $S_{BN}$ of the recycle solvent is greater than 120 to about 150.

18. The process of claim 17, wherein the $S_{BN}$ of the recycle solvent is about 130 to about 150.

19. The process of claim 13, wherein after centrifuging, the lower viscosity, reduced reactivity tar is free of solids having a size of greater than 25 μm.

20. The process of claim 13, wherein the utility fluid comprises two-ring aromatics, three-ring aromatic, four-ring aromatics, or any combination thereof.

21. The process of claim 13, wherein the utility fluid comprises a solvent selected from the group consisting of benzene, ethylbenzene, trimethylbenzene, xylenes, toluene, naphthalenes, alkylnaphthalenes, tetralins, alkyltetralins, and any combination thereof.

22. A process for preparing a liquid hydrocarbon product comprising:

heat soaking a tar stream to produce a reduced reactivity tar having a bromine number of no greater than 28;

blending the reduced reactivity tar with a utility fluid to produce a lower viscosity, reduced reactivity tar;

hydroprocessing the lower viscosity, reduced reactivity tar at a temperature of greater than 350° C. to produce a total liquids product (TLP) comprising the liquid hydrocarbon product and a recycle solvent;

separating the recycle solvent from the TLP;

measuring a solubility blending number ($S_{BN}$) of the recycle solvent;

increasing the temperature of the lower viscosity, reduced reactivity tar during the hydroprocessing if the $S_{BN}$ of the recycle solvent is less than 115; and flowing the recycle solvent to the reduced reactivity tar for blending to produce the lower viscosity, reduced reactivity tar.

23. The process of claim 22, wherein the temperature of the lower viscosity, reduced reactivity tar is about 400° C. to about 450° C.

24. The process of claim 22, wherein the utility fluid comprises the recycle solvent, and wherein the $S_{BN}$ of the recycle solvent is about 130 to about 150.

25. A process for preparing a liquid hydrocarbon product comprising:

heat soaking a tar stream to produce a first process stream comprising a reduced reactivity tar having a bromine number of no greater than 28;

blending the first process stream with a utility fluid to reduce viscosity of the first process stream and produce a second process stream comprising solids and a reduced reactivity, lower viscosity tar;

centrifuging the second process stream to produce a third process stream comprising the reduced reactivity, lower viscosity tar and having a concentration of solids less than the second process stream;

hydroprocessing the third process stream at a temperature of greater than 350° C. to about 450° C. to produce a fourth stream comprising the liquid hydrocarbon product and a recycle solvent;

separating the recycle solvent from the fourth stream, wherein the recycle solvent has a solubility blending number ($S_{BN}$) of about 130 to about 150; and flowing the recycle solvent to the first process stream for blending to produce the second process stream.

26. A process for producing a hydroprocessed tar, the process comprising:

(a) providing a process stream comprising a reduced reactivity tar having a bromine number of no greater than 28;

(b) mixing the process stream with a utility fluid having a solubility blending number ($S_{BN}$)<110 to produce a tar-fluid mixture;

(c) catalytically hydroproces sing the tar-fluid mixture produce a total liquids product (TLP) comprising the liquid hydrocarbon product and the utility fluid;

(d) separating a recycle solvent and a hydroprocessed tar from the TLP, wherein the recycle solvent has a true boiling point range that is substantially the same as that of the utility fluid, and has a solubility blending number ($S_{BN}$) of greater than 110; and (e) substituting at least a portion of the recycle solvent for the utility fluid in step (b).

* * * * *